US007246389B2

(12) United States Patent
Taguchi et al.

(10) Patent No.: US 7,246,389 B2
(45) Date of Patent: Jul. 24, 2007

(54) ADJUSTABLE BED

(75) Inventors: Kenji Taguchi, Hirakata (JP); Hiroshi Abe, Hirakata (JP); Masashi Morikawa, Takatsuki (JP); Hideo Kawakami, Hirakata (JP); Atsushi Ogawa, Kyoto (JP)

(73) Assignee: Sanyo Electric Co., Ltd., Osaka (JP)

( * ) Notice: Subject to any disclaimer, the term of this patent is extended or adjusted under 35 U.S.C. 154(b) by 37 days.

(21) Appl. No.: 10/505,156

(22) PCT Filed: Feb. 14, 2003

(86) PCT No.: PCT/JP03/01518

§ 371 (c)(1),
(2), (4) Date: Aug. 20, 2004

(87) PCT Pub. No.: WO03/073973

PCT Pub. Date: Sep. 12, 2003

(65) Prior Publication Data

US 2005/0160530 A1 Jul. 28, 2005

(30) Foreign Application Priority Data

Feb. 22, 2002 (JP) ..... 2002-046936
Aug. 26, 2002 (JP) ..... 2002-245647

(51) Int. Cl.
*A61G 7/015* (2006.01)
*A61G 7/018* (2006.01)
*A61G 7/008* (2006.01)

(52) U.S. Cl. ..... 5/618; 5/616; 5/613; 5/608; 5/942

(58) Field of Classification Search ..... 5/618, 5/616, 617, 619, 613, 608, 942, 411, 723, 5/621, 623, 624, 646–648; 128/845, 846, 128/869, 870, 878, 879
See application file for complete search history.

(56) References Cited

U.S. PATENT DOCUMENTS 554,580 A * 2/1896 Conkwright ..... 5/618

(Continued)

FOREIGN PATENT DOCUMENTS

JP 2-111426 A 4/1990

(Continued)

OTHER PUBLICATIONS

Office Action dated May 23, 2006.

(Continued)

*Primary Examiner*—Robert G. Santos
(74) *Attorney, Agent, or Firm*—McDermott Will & Emery LLP

(57) ABSTRACT

An adjustable bed includes a platform having a flexible surface, a flex mechanism adapted to flex the platform to form a flexion position that includes at least one of a sitting-up position and a knee break, and a tilt mechanism adapted to tilt the platform surface laterally, the flex and tilt mechanisms both being operable with the other mechanism in an operational state. Furthermore, the adjustable bed includes a side member disposed on a side of the platform, and a side-member lift mechanism adapted to raise the side member relative to the platform surface, the tilt mechanism tilting the platform surface toward the side member raised by the side-member lift mechanism.

20 Claims, 28 Drawing Sheets

U.S. PATENT DOCUMENTS

| | | | | | |
|---|---|---|---|---|---|
| 1,021,335 | A | | 3/1912 | Robinson | |
| 1,559,119 | A | * | 10/1925 | Miller | 5/411 |
| 1,842,873 | A | * | 1/1932 | Leeking | 5/411 |
| 2,588,854 | A | * | 3/1952 | Lang | 5/618 |
| 2,995,762 | A | * | 8/1961 | Albinson | 5/411 |
| 3,474,781 | A | * | 10/1969 | Gaylord, Jr. | 128/876 |
| 3,861,666 | A | * | 1/1975 | Nishiyama et al. | 5/601 |
| 4,127,906 | A | * | 12/1978 | Zur | 5/615 |
| 4,135,504 | A | * | 1/1979 | Spann | 602/24 |
| 4,225,988 | A | * | 10/1980 | Cary et al. | 5/607 |
| 4,287,620 | A | * | 9/1981 | Zur | 5/615 |
| 4,372,299 | A | * | 2/1983 | Fixel | 602/24 |
| 4,662,366 | A | * | 5/1987 | Tari | 128/877 |
| 4,683,601 | A | * | 8/1987 | Lagin | 5/652 |
| 4,726,083 | A | * | 2/1988 | Hoshall | 5/411 |
| 4,899,404 | A | * | 2/1990 | Galumbeck | 5/616 |
| 4,910,818 | A | * | 3/1990 | Grabill et al. | 5/650 |
| 4,941,221 | A | * | 7/1990 | Kanzler | 5/615 |
| 5,117,522 | A | * | 6/1992 | Everett | 5/648 |
| 5,125,122 | A | * | 6/1992 | Chen | 5/618 |
| 5,125,123 | A | * | 6/1992 | Engle | 5/648 |
| 5,134,739 | A | * | 8/1992 | Gaffe et al. | 5/648 |
| 5,224,228 | A | * | 7/1993 | Larrimore | 5/613 |
| 5,303,437 | A | * | 4/1994 | Hung | 5/613 |
| 5,392,479 | A | * | 2/1995 | Liao | 5/618 |
| 5,400,448 | A | * | 3/1995 | Zwickey | 5/691 |
| 5,479,665 | A | * | 1/1996 | Cassidy et al. | 5/613 |
| 5,500,964 | A | * | 3/1996 | Bergersen | 5/607 |
| 5,502,853 | A | | 4/1996 | Singleton et al. | |
| 5,535,464 | A | * | 7/1996 | Salonica | 5/604 |
| 5,549,121 | A | * | 8/1996 | Vinci | 128/878 |
| 5,608,932 | A | * | 3/1997 | Hasegawa | 5/611 |
| 5,613,252 | A | * | 3/1997 | Yu et al. | 5/88.1 |
| 5,625,913 | A | | 5/1997 | Singleton | |
| 5,746,218 | A | * | 5/1998 | Edge | 128/845 |
| 5,754,997 | A | | 5/1998 | Lussi et al. | |
| 5,871,457 | A | * | 2/1999 | Swedberg et al. | 602/24 |
| 5,878,453 | A | * | 3/1999 | Stokes | 5/648 |
| 6,154,905 | A | * | 12/2000 | Frydman | 5/648 |
| 6,182,314 | B1 | * | 2/2001 | Frydman | 5/648 |
| 6,830,050 | B1 | * | 12/2004 | Bamdad et al. | 128/845 |
| 6,889,396 | B2 | * | 5/2005 | Weinman | 5/411 |
| 7,007,327 | B2 | * | 3/2006 | Ogawa et al. | 5/609 |
| 7,017,210 | B2 | * | 3/2006 | Ooyama et al. | 5/619 |
| 7,017,994 | B2 | * | 3/2006 | Suck et al. | 297/341 |
| 2001/0027577 | A1 | * | 10/2001 | Frydman | 5/648 |
| 2002/0116764 | A1 | | 8/2002 | Plummer et al. | |
| 2004/0103475 | A1 | * | 6/2004 | Ogawa et al. | 5/613 |
| 2005/0028281 | A1 | * | 2/2005 | Ooyama et al. | 5/618 |
| 2005/0091749 | A1 | * | 5/2005 | Humbles | 5/646 |
| 2005/0160530 | A1 | * | 7/2005 | Taguchi et al. | 5/618 |
| 2005/0166323 | A1 | * | 8/2005 | Kawakami et al. | 5/610 |
| 2005/0172405 | A1 | | 8/2005 | Menkedick et al. | |
| 2006/0085913 | A1 | * | 4/2006 | Kawakami et al. | 5/618 |

FOREIGN PATENT DOCUMENTS

| | | | |
|---|---|---|---|
| JP | 5-41534 | | 6/1993 |
| JP | 07-116199 | | 5/1995 |
| JP | 07-163623 | | 6/1995 |
| JP | 11-206513 | | 8/1999 |
| JP | 11-239524 | | 9/1999 |
| JP | 2001-008979 | A | 1/2001 |
| JP | 2001-293037 | | 10/2001 |
| WO | WO 02/074221 | A1 | 9/2002 |

OTHER PUBLICATIONS

Supplementary Partial European Search Report issued in corresponding European Patent Application No. EP 03 70 5137, dated Sep. 29, 2006.

Supplementary European Search Report issued in corresponding European Patent Application No. EP03705137.2, dated Jan. 17, 2007.

* cited by examiner

LOAD SAFETY CONTROL FLOWCHART

HORIZONTAL SYNC FLOWCHART

FLAT STATE

SLIDE CHIP SLIDES ON SLIDE BLOCK

LOAD TRANSFER FROM SLIDE CHIP TO ROLLER

ROLLER MOVES ALONG RAIL, STABILIZING PLATFORM 11d

PILLOW

ARMREST

LEGREST

ADJUSTABLE BED

TECHNICAL FIELD

The present invention relates to adjustable beds for use in nursing care and the like, and particularly to improving the mechanism for turning users of the bed, such as care recipients, between supine and lateral positions.

BACKGROUND ART

Generally, with adjustable beds used as turning beds and the like to assist the postural change of care recipients in order to prevent the occurrence of decubitus ulcers, more commonly known as bedsores, the person is turned by tilting at least part of the mattress on which the person is lying at an angle (see Japanese Published Patent Publication No. 6-14824). The majority of these types of beds employ a mechanism that tilts the mattress toward one side or the other from a horizontal position.

Using this mechanism employed in turning beds, the posture of the care recipient is changed from a position lying flat on a horizontal mattress (i.e. supine) to a lateral position in which the person is lying on either their left or right side (i.e. lateral). Here, the most stable posture for a person turning laterally is a flexion position with knees bent and hips flexed. For this reason the caregiver, when moving the care recipient from a supine to a lateral position, preferably adjusts the person's posture to be suitably placed in a flexion position.

While typical turning beds support postural changes from a supine to a lateral position, they do not, however, go as far as to change posture to a flexion position. To achieve a flexion position, the caregiver is thus forced, after the turning bed has turned the person, to manually change the care recipient's posture while supporting the person's body weight. Apart from requiring considerable strength on the part of the caregiver, the care recipient may be caused both physical discomfort due to the caregiver's lack of experience in performing this difficult task, and psychological anxiety each time the task is periodically performed.

Consequently, one cannot honestly say, from the viewpoint of care recipients, that currently available turning beds provide adequate care.

DISCLOSURE OF THE INVENTION

In view of the above problem, the present invention aims to provide an adjustable bed capable of facilitating postural changes, while minimizing any physical discomfort or psychological anxiety caused to a care recipient using the bed.

The object of the present invention is achieved by an adjustable bed that includes a platform having a flexible surface; a flex mechanism adapted to flex the platform to form a flexion position that includes at least one of a sitting-up position and a knee break; and a tilt mechanism adapted to tilt the platform surface laterally, the flex and tilt mechanisms both being operable with the other mechanism in an operational state.

Since the care recipient, according to this structure, is able to achieve postural changes to a flexion position and from a supine to a lateral position using the turning bed, positional changes from a supine to a lateral position and vice versa are performed excellently by operations that are just like those carried out by the guiding hand of a caregiver.

Since this invention enables the care recipient to achieve postural changes while in a flexion position, which exerts the least burden on the care recipient's body, it is possible for the care recipient to look forward to an easing of the physical discomfort and psychological anxiety experienced to date. The care recipient is thus able to comfortably face postural changes, and the occurrence of decubitus ulcers can be effectively suppressed.

Furthermore, since the caregiver, when the present invention is used, is not required to perform overly exerting manual tasks when changing the posture of the care recipient, it is possible for even a caregiver with little experience to correctly perform postural changes. The caregiver, having had their burden reduced, is thus better able to focus on providing the best care possible.

The adjustable bed may include a side member disposed on a side of the platform; and a side-member lift mechanism adapted to raise the side member relative to the platform surface, and the tilt mechanism may tilt the platform surface toward the side member raised by the side-member lift mechanism. This enables the care recipient to be safely supported on the sides by the side member when postural changes are performed.

The present invention may, specifically, be realized by the adjustable bed including a side member disposed on either side of the platform, the tilt mechanism including an elevation mechanism adapted to elevate the pair of side members up and down, and the platform surface being tilted and the side member at a lower end thereof being raised relative to the platform surface by elevating at least one side of the platform surface using the elevation mechanism.

More specifically, the platform may be formed from a plurality of surface members supported from underneath by an adjustable stage that oscillates on a fixed stage, the flex mechanism may have an actuator disposed on an underside of the platform and adapted to flex the platform by tilting one or more of the surface members, the tilt mechanism may have a first and a second elevation mechanism capable of elevating both sides of the adjustable stage independently, and the flex and tilt mechanisms may be independently operable.

By providing elevation mechanisms capable of independent elevation as described above, and operating these elevation mechanisms in sync in addition to tilting the platform, it is possible to elevate (raise/lower) the platform (i.e. to operate a high/low mechanism).

More specifically, the platform may be a coupled platform formed from the surface members being coupled together, the flex mechanism may drive the actuator, which is disposed on the underside of the coupled platform, to flex the coupled platform, the first and second elevation mechanisms may each include a parallelogram mechanism adapted to elevate sides of the adjustable stage in a perpendicular direction using (i) a plurality of support arms that hang down parallel with one another from the respective side of the adjustable stage so as to extend in line with the side, (ii) a horizontal link arm disposed with respect to the support arms so as to extend in line with a flat surface of the bed, and (iii) a slide groove member disposed horizontally and connected to a lower end of the support arms so as to allow the support arms to travel freely, and the platform surface may be tilted by separating one side of the adjustable stage and the respective horizontal link arm using another actuator, to lift the side.

Furthermore, the side members may each be formed from (i) a first side member having a slot in a thickness direction, and (ii) a second side member housed in the slot and coupled to the first side member and the platform, and the tilt mechanism may be structured such that the second side member is pulled from the slot in the first side member when the platform surface is tilted. Substantially the same effects as those described above are also achieved by this configuration.

Also, an adjustable bed that achieves the above object may be structured to include a plurality of airbags laid along a bed surface; a sidewall lift mechanism adapted to inflate airbags provided on side parts of the bed surface, to form a pair of sidewalls; a flex mechanism adapted to form a flexion position that includes at least one of a sitting-up position and a knee break, by inflating or deflating an airbag provided on a middle part of the bed surface; and a tilt mechanism adapted to inflate or deflate airbags provided on the middle and side parts after the sidewall lift mechanism is operated, so as to tilt the bed surface of the middle part toward one of the sidewalls, the flex and tilt mechanisms both being operable with the other mechanism in an operational state. Substantially the same effects as those described above are also achieved by this configuration.

BEST MODE FOR CARRYING OUT THE INVENTION

1. Embodiment 1

1.1 Structure of Turning Bed

Figure 1:
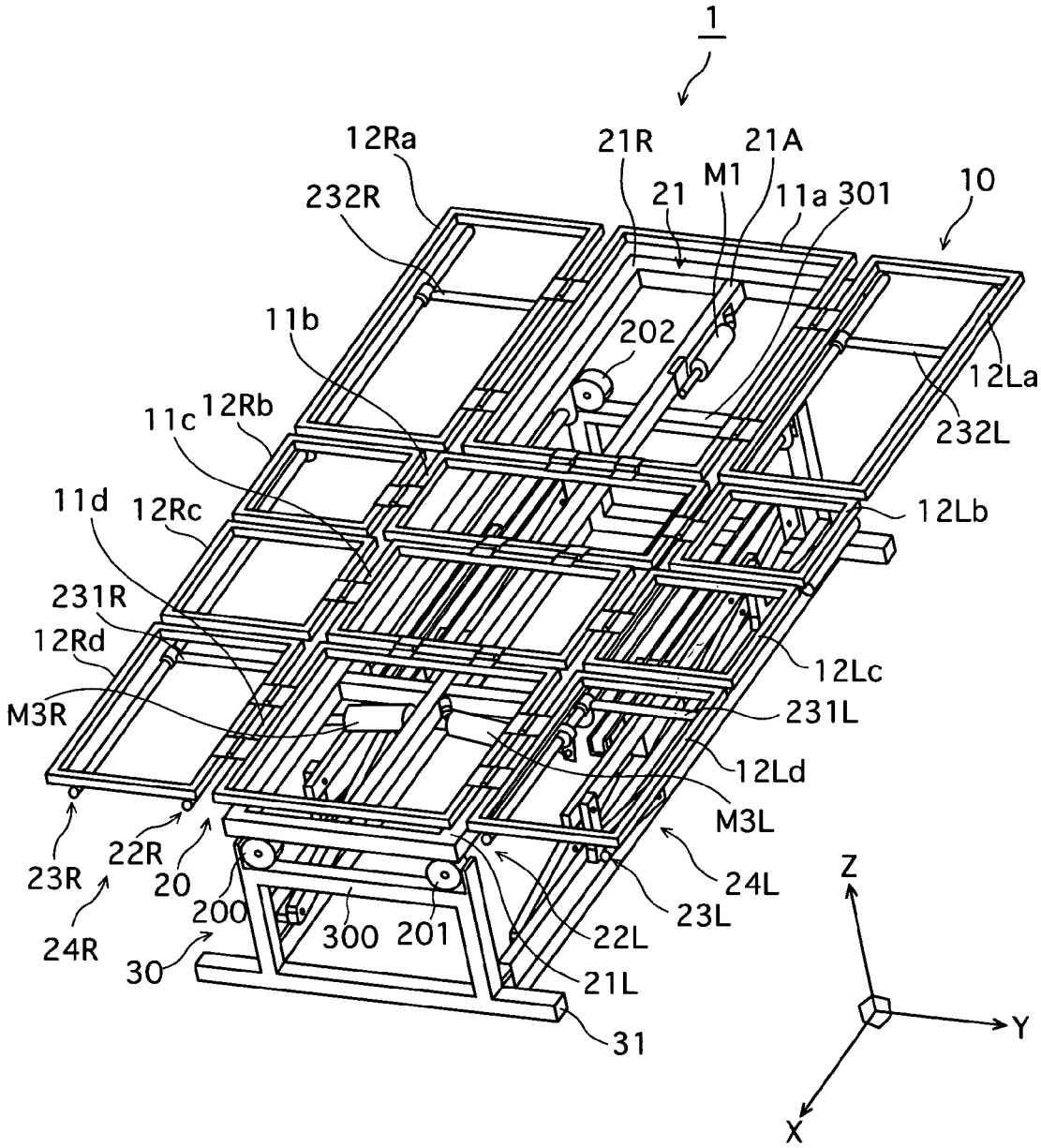
FIG. 1 is a perspective view of a turning bed in an embodiment 1.

FIG. 1 is a perspective view showing a structure of a turning bed 1 relating to an embodiment 1 of the present invention.

Turning bed 1 is constituted such that a bed frame 10 is disposed on an adjustable stage 20 sitting on a fixed stage 30.

Figure 3:
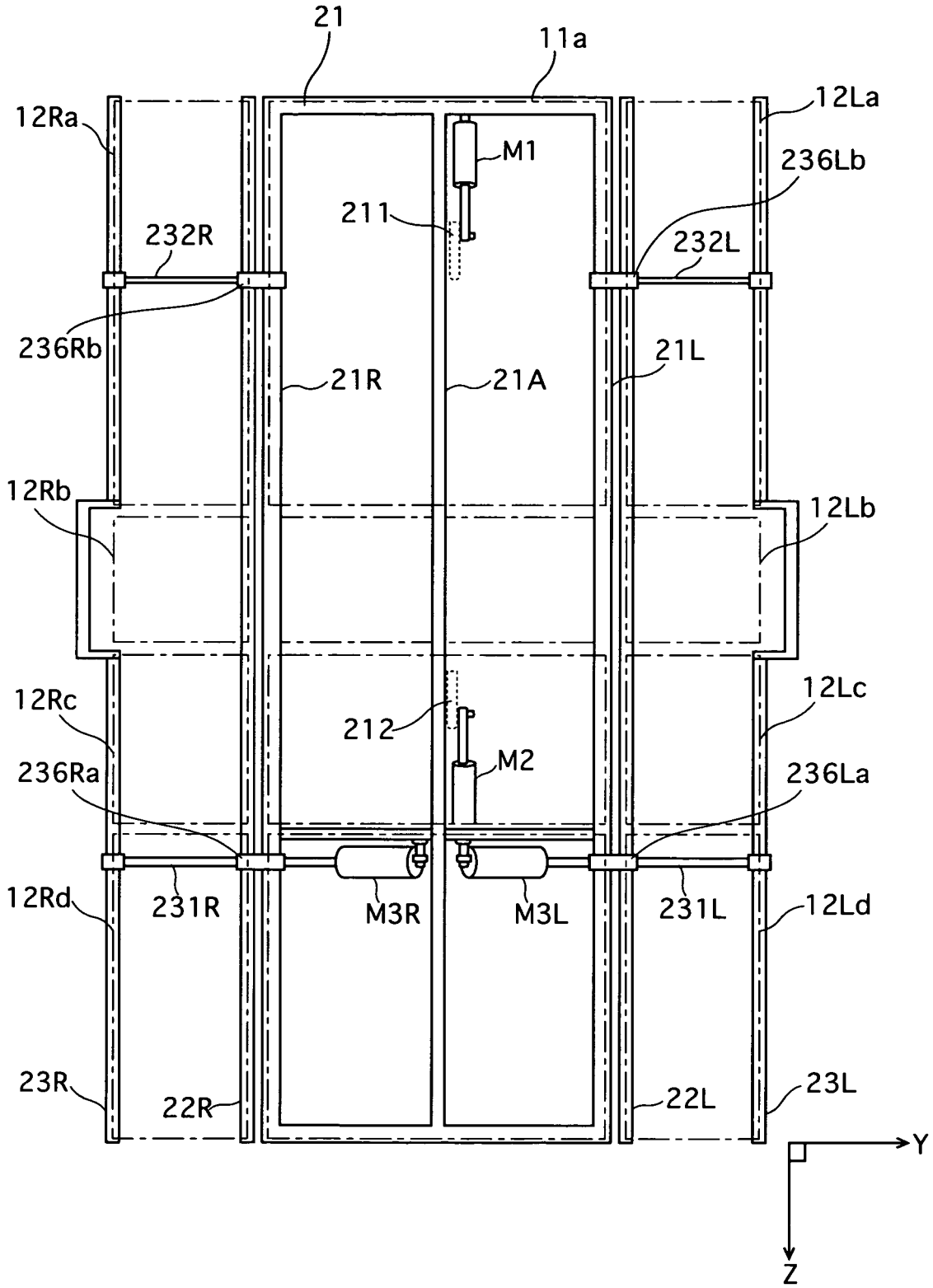
FIG. 3 is a schematic plan view of the turning bed.

Bed frame 10 includes coupled platforms 11*a* to 11*d*, which are formed by dividing a surface section (i.e. upper surface of the bed) into four articular sections corresponding to the back, hip, upper leg, and lower leg regions of the care recipient's body when lying on the bed, and coupling these sections together so as to be fully adjustable. Of these four coupled platforms 11*a*-11*d*, lower-back board 11*b* is fixed directly to adjustable stage 20 by being welded, for example, thus preventing bed frame 10 from separating from adjustable stage 20. Side members 12Ra-12Rd and 12La-12Ld for supporting the care recipient's body from the side are coupled to platforms 11*a*-11*d* on the right and left, respectively. Since upper-body board 11*a* and upper-leg board 11*c* of bed frame 10 are respectively coupled, via L-shaped couplers 211 and 212, to the axial parts of direct-acting actuators M1 and M2 (see FIG. 3 plan view of bed) disposed on a center frame part 21A of adjustable stage 20, the care recipient is placed in the flexion position by operating actuators M1 and M2 (see FIGS. 6 and 8B).

Figure 5:
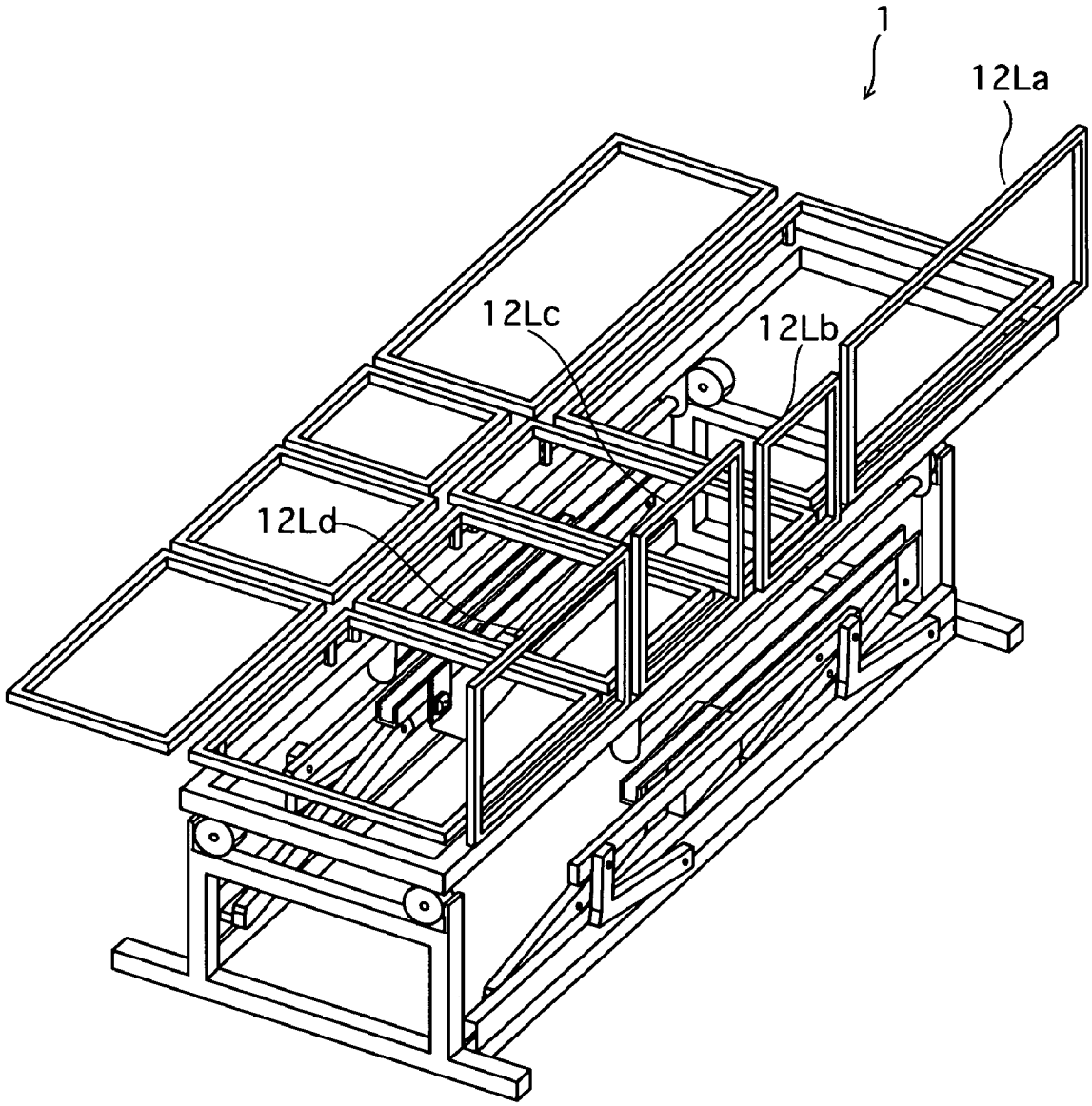
FIG. 5 is a perspective view of the turning bed (left side members raised)
Figure 6:
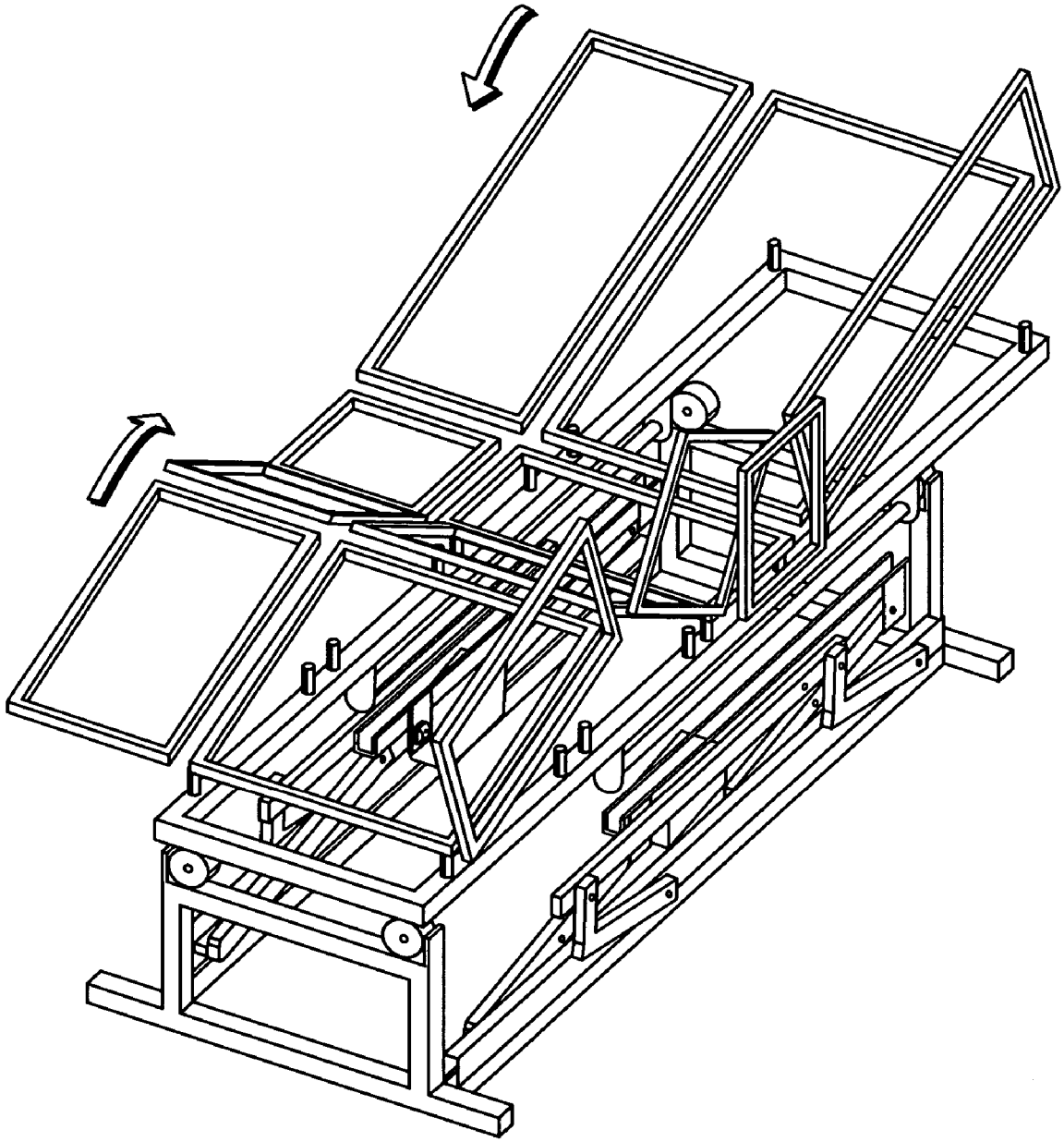
FIG. 6 is a perspective view of the turning bed (flexion position)
Figure 7:
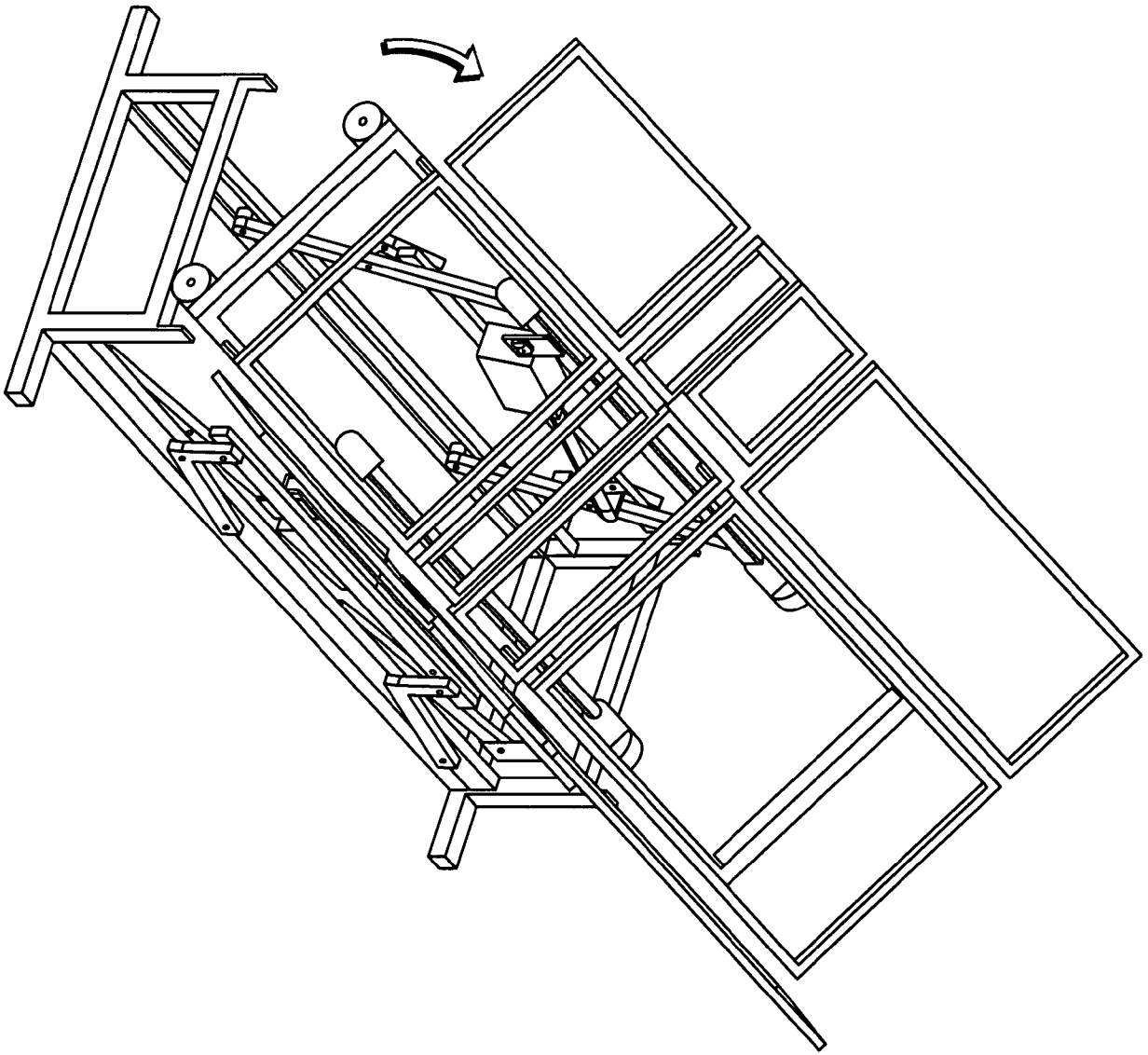
FIG. 7 is a perspective view of the turning bed (sloping from right to left)

Coupled platforms 11*a*-11*d* and side members 12Ra-12Rd/12La-12Ld of bed frame 10 are in actual fact covered by wire mesh, although in order to clearly depict the bed's structure, this wire mesh has been omitted from the drawings, which consequently depict only the frames of platforms 11*a*-11*d* and side members 12Ra-12Rd/12La-12Ld. In the present invention, the platforms and side members are not restricted to having a wire mesh surface construction, and may alternatively be formed from coupled pieces of a sheet material. In FIGS. 5 to 7 showing bed operations, certain parts of the structure, such as side-member support frames 24R/24L, for example, have been omitted so as to clearly illustrate the operations.

Figure 8A:
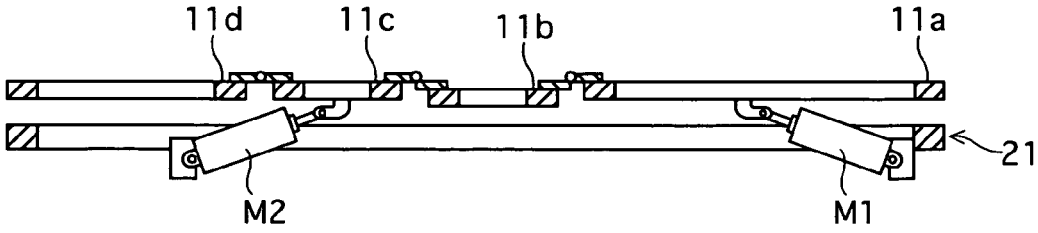
FIGS. 8A to 8D are longitudinal schematic views of a bed frame and an adjustable stage.
Figure 8B:
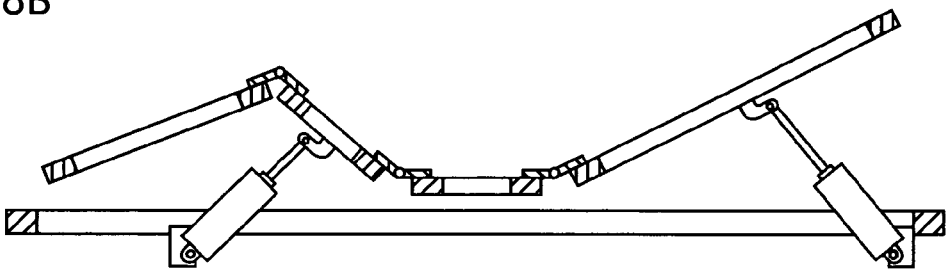
Figure 8C:
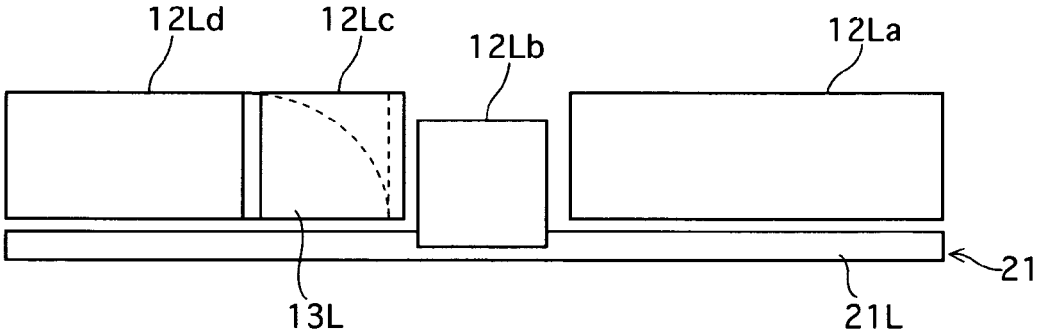
Figure 8D:
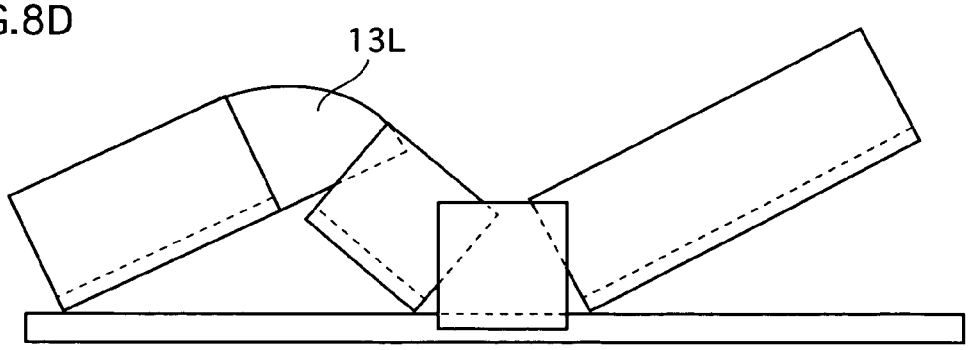

On the surface of side members 12Rc/12Lc is disposed an envelope-shaped pocket of approximately the same size as side members 12Rc/12Lc (see FIG. 8D side view of bed). Fan-shaped boards 13R/13L (13R not depicted) are coupled to the ends of side members 12Rd/12Ld corresponding the care recipient's lower leg region, these boards normally being housed in the pockets of side members 12Rc/12Lc, respectively. Then, when bed frame 10 changes to the flexion position, fan-shaped boards 13R and 13L come out of the pockets to support the care recipient's knee region.

Adjustable stage 20 has a rectangular frame construction formed from center frame part 21A, side frame parts 21R/21L, and two parallel end frame parts connected to either end of the center and side frame parts. Rollers 200, 201, 202 and 203 (roller 203 hidden beneath bed frame 10 in FIG. 1) are disposed on side frame parts 21R/21L, and are able to slide in a y direction along the top of roller-track frame parts 300 and 301 of fixed stage 30, as shown in FIG. 1.

Ladder-shaped side-member support frames 24R/24L are disposed on side frame parts 21R/21L of adjustable stage 20, and formed respectively from two bars 22R/23R and 22L/23L that run along side frame parts 21R/21L, and two couplers 231R/232R and 231L/232L. Bars 23R/23L bend outwards in an area where side-member support frames 24R/24L correspond to side members 12Rb/12Lb, with side members 12Rb/12Lb lying within the space provided by the outwardly bent section (see FIG. 3 plan view of bed). Side members 12Rb/12Lb and side members 12Ra/12La and 12Rc/12Lc on either side of 12Rb/12Lb are designed so as not to interfere with one another in a width direction when bed frame 10 changes to the flexion position. Bars 22R/22L are coupled respectively to bars 23R/23L by couplers 231R/232R and 231L/232L, allowing bars 22R/22L to rotate freely in an axial direction while remaining secured to side frame parts 21R/21L of adjustable stage 20. When side-member support frames 24R/24L are rotated on the axis of rotating bars 22R/22L to a position perpendicular with the horizontal bed (i.e. so as to point in the z direction), side members 12Ra-12Rd/12La-12Ld of bed frame 10 are pushed up, enabling the right and left sides of bed frame 10 to be raised.

Figure 2A:
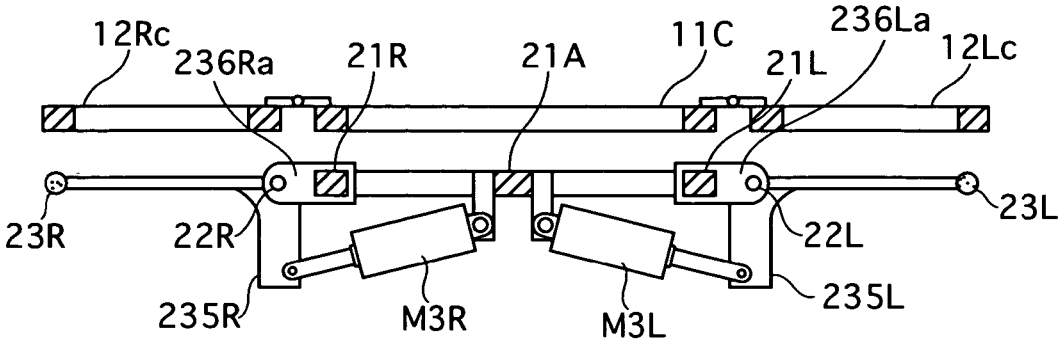
FIGS. 2A to 2C are partial cross-sectional views in a vicinity of a bed frame and an adjustable stage.
Figure 2B:
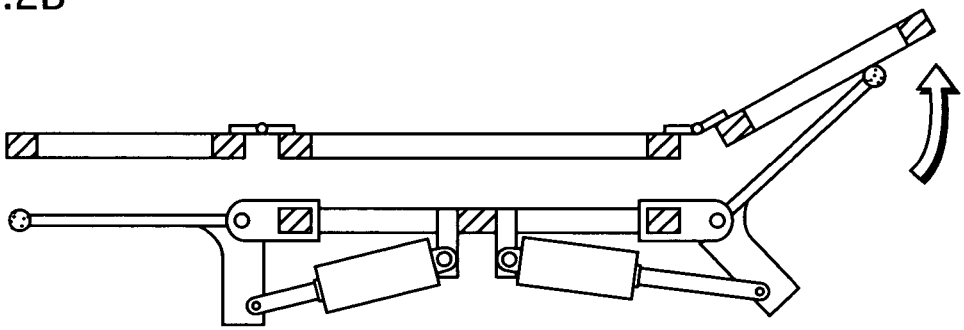
Figure 2C:
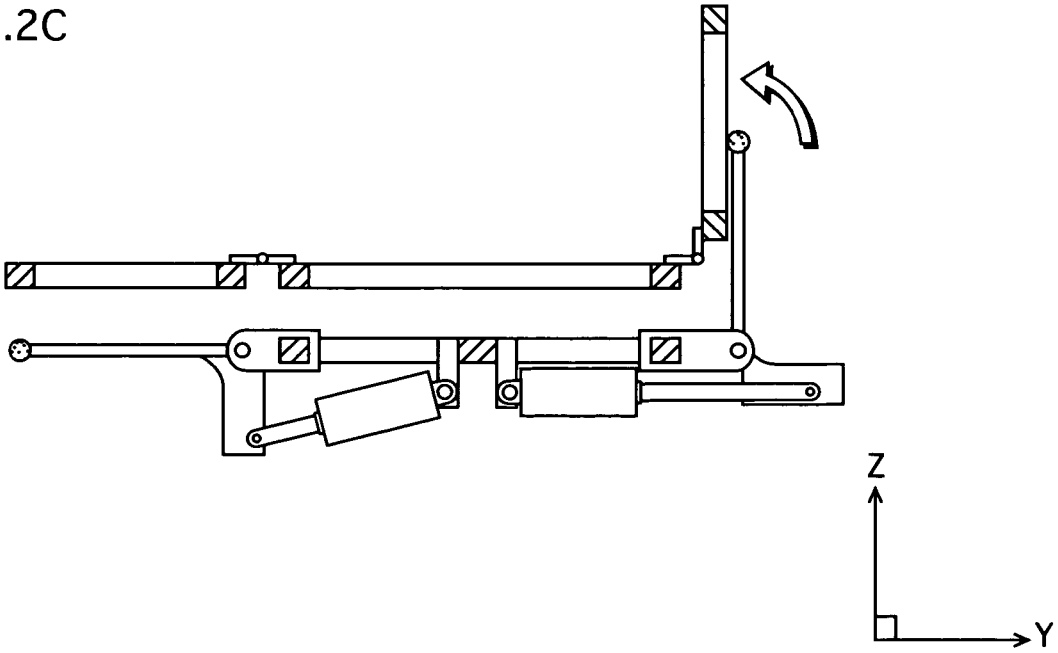

Here FIGS. 2A to 2C are schematic sectional views of the bed showing the operation of actuators in a vicinity of adjustable stage 20 and lower-back board 11*c* of bed frame 10. In addition to actuators M1 and M2 used for changing the shape of bed frame 10, direct-acting actuators M3R/M3L are, as shown in FIGS. 2A-2C, disposed symmetrically on adjustable stage 20 so as to extend respectively to the left and right of center frame part 21A (i.e. in the y direction toward coupling members 236Ra/236La, respectively), the head of the axial parts of actuators M3R/M3L being coupled to L-shaped members 235R/235L fixed below rotating bars 22R/22L. According to this structure, L-shaped members 235R/235L and bars 23R/23L are rotated on the axis of rotating bars 22R/22L due to the axial parts of actuators M3R/M3L being extended, which raises side-member support frames 24R/24L from the horizontal to a position perpendicular with the horizontal (FIGS. 2A→2B→2C).

Stage bars 27R/27L are provided on the underside of side frame parts 21R/21L, and mate with stage-bar receivers 36R/36L (U-shaped cross-section) on fixed stage 30. Stage-bar receivers 36R/36L each have a reverse L-shaped claw that runs internally in a width direction, adjustable stage 20 being secured in a vertical direction by these claws hooking around stage bars 27R/27L. When adjustable stage 20 is tilted, the stage bar (i.e. either 27R or 27L) on one side separates from the stage-bar receiver (i.e. either 36R or 36L).

Adjustable stage 20 and fixed stage 30 can also be coupled together using the following mechanism. For example, pole-shaped members (swing bars) that extend in a longitudinal direction of the bed may be provided on the underside of side frame parts 32R/32L on fixed stage 30, and an engaging mechanism provided with respect to the swing bars that is capable of being locked/unlocked automatically when the bed is operated. The swing bars are structured to mate with grips provided on fixed stage 30. The swing bars mate with the grips when side members 12Ra-12Rd/12La-12Ld are horizontal, locking the engaging mechanism. Raising the swing bar on one side when the bed is operated raises the side members on the corresponding side (i.e. 12Ra-12Rd or 12La-12Ld). This unlocks the engaging mechanism on the side that is raised, allowing adjustable stage 20 to be tilted.

Since this mechanism enables adjustable stage 20 to remain securely coupled to fixed stage 30 when the bed is normally positioned (horizontal), and to be separated from fixed stage 30 only when necessary, operational safety is improved.

Figure 4:
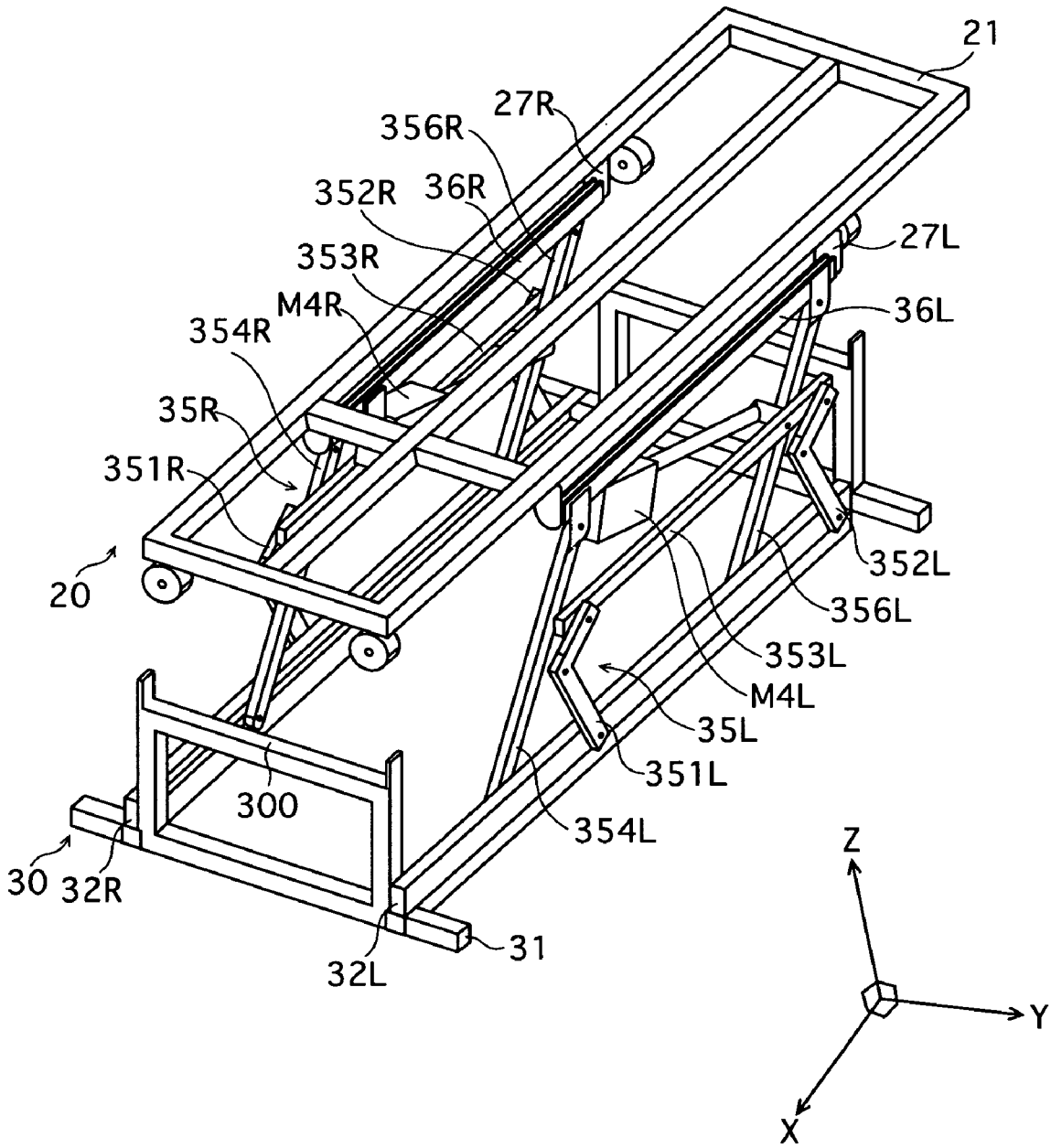
FIG. 4 is a perspective view showing a structure of a fixed stage.

FIG. 4 is a perspective view showing a structure of fixed stage 30. Fixed stage 30 includes a rectangular frame 31. The opposing ends of frame 31 form roller-track frame parts 300 and 301, with rollers 200-203 of adjustable stage 20 being able to travel back and forth along the tops of frame parts 300 and 301. The ends of support arms 354R/356R and 354L/356L coupled respectively to stage-bar receivers 36R/36L are fitted into side frame parts 32R/32L so as to have free travel. Reverse L-shaped rotating arms 351R/352R and 351L/352L coupled at one end to side frame parts 32R/32L are linked to support arms 354R/356R and 354L/356L, and horizontal links 353R and 353L are coupled to rotating arms 351R/352R and 351L/352L. Actuators M4R/M4L are disposed at an angle between stage-bar receivers 36R/36L and horizontal links 353R/353L, respectively. Parallelogram mechanisms 35R/35L applies as horizontal slide mechanisms are thus formed on the right and left sides of fixed stage 30. With parallelogram mechanisms 35R/35L, rotating arms 351R/352R and 351L/352L move in a circular motion around the points at which they are coupled to side frame parts 32R/32L, and support arms 354R/356R and 354L/356L travel back and forth at one end on the inside of side frame parts 32R and 32L, while being regulated by rotating arms 351R/352R and 351L/352L. Oscillating support arms 354R/356R and 354L/356L enable adjustable stage 20, supported by stage-bar receivers 36R/36L, and bed frame 10 to be elevated vertically from both the right and left sides of fixed stage 30. Consequently, turning bed 1 can be elevated even in the narrow spaces that result from space saving, while the use of rollers 200-203 and parallelogram mechanisms 35R and 35L enables space to be saved even during postural change operations. Postural changes from a supine to a lateral position are achieved when one of parallelogram mechanisms 35R/35L corresponding respectively to side frame parts 32R/32L is driven, while a high/low (height adjustment) mechanism of the bed is realized when parallelogram mechanisms 35R/35L are driven simultaneously.

Actuators M1/M2 and M3R/M3L are controlled by a CPU 601 and a motor driver 603 in a control unit 600, the caregiver being able to carry out drive settings (e.g. manual/automatic, program settings, etc) using a controller (not depicted). Also, the provision of a cable (cord attached, etc) or wireless (infrared, etc) remote controller enables settings to also be performed by the care recipient.

1-2. Operation of Turning Bed (Supine→Lateral)

A turning bed having the above structure is used with a mattress placed on bed frame 10. In a normal configuration, coupled platforms 11*a*-11*d* and side members 12Ra-12Rd/12La-12Ld are set, as shown in FIG. 1, to be substantially horizontal.

When a user (a caregiver in the given example) selects, via the controller, an item relating, for example, to "supine→left lateral in flexion position" from a menu and has this selection executed, actuator M3L attached to adjustable stage 20 is firstly operated, the axial part of actuator M3L extending outward. L-shaped member 235L coupled to the end of the axial part and bar 23L rotate around rotating bar 22L, and side-member support frame 24L rise from a horizontal position toward a position vertical with the flat surface of the bed (see FIGS. 2A→2B→2C showing actuator operations; FIG. 5 showing side members 12La-12Ld in a raised state; FIG. 8C showing side view of bed in this state).

Next, the axial parts of direct-acting actuators M1 and M2 attached to center frame part 21*a* of adjustable frame 20 extend out, pushing upper-body and upper-leg boards 11*a*/11*c* of bed frame 10 up from underneath via L-shaped couplers 211/212 to place the care recipient in a flexion position with upper body raised and knees up (i.e. sitting-up position and knee break; see FIG. 6 showing perspective view of bed in flexion position; FIGS. 8A→8B showing side views of the bed in this state). The positioning of side member 12La-12Ld also changes in unison with coupled platforms 11*a*-11*d*. Fan-shaped board 13L comes out from the pocket provided on side member 12Lc to cover parts of the mattress around the care recipient's knee region (see FIGS. 8C→8D showing side views of the bed in this state). The tilt angle (i.e. angle of inclination) of the upper leg when in the flexion position preferably is set in a range of 10 degrees to 60 degrees inclusive, since this effectively prevents the care recipient from rolling in the direction of the incline. A tilt angle in a range of 20 degrees to 40 degrees inclusive is more preferable.

When the flexion position with the left side members raised is achieved as described above, actuator M4R on the right side of fixed stage 30 operates and the axial part of the actuator extends outward. As a result, stage-bar receiver 36R and horizontal link 353R separate from one another at an angle, support arms 354R and 356R slide along the slide channel in side frame part 32R and rise up, and parallelogram mechanism 35R operates. Support arms 354R and 356R (or 354L, 356L) thus raise one side of the adjustable stage vertically upwards as a result of the circular movement of rotating arms 351R and 352R (or 351L, 352L). At the same time, the right side of adjustable stage 20 is raised to a higher position than fixed stage 30, rollers 200-203 of adjustable stage 20 roll along the top of roller-track frame parts 300 and 301, and bed frame 10 tilts toward side frame part 32L of fixed stage 30; that is, toward the left side of the bed (see FIG. 7 perspective view of bed when tilted). Here, a tilt angle in a range, for example, of approximately 30 degrees to 70 degrees inclusive is preferable, one example being a tilt angle of 50 degrees.

As a result of the above transformations in shape of bed frame 10, the posture of the care recipient is changed smoothly from a supine to a lateral position while being supported by coupled platforms 11*a*-11*d* and side members 12La-12Ld, after firstly being placed in a supine flexion position with upper body raised and knees bent. An excellent posture similar to when a care recipient is turned by the guiding hand of a caregiver is thus realized.

Since embodiment 1 allows postural changes to be performed while in a flexion position, which exerts the least burden on the care recipient's body, the care recipient is able to comfortably face postural changes, and can look forward to an easing of the physical discomfort and psychological anxiety associated with postural changes to date.

Furthermore, since the caregiver is not required to perform overly exerting manual tasks when changing the posture of the care recipient, it is possible for even a caregiver with little experience to correctly perform postural changes. By using turning bed 1 of embodiment 1, the caregiver is thus better able to focus on providing the best care possible.

1-3. Variation of Turning Bed Operation 1-3-1. Operation Sequence Variation

Figure 9:
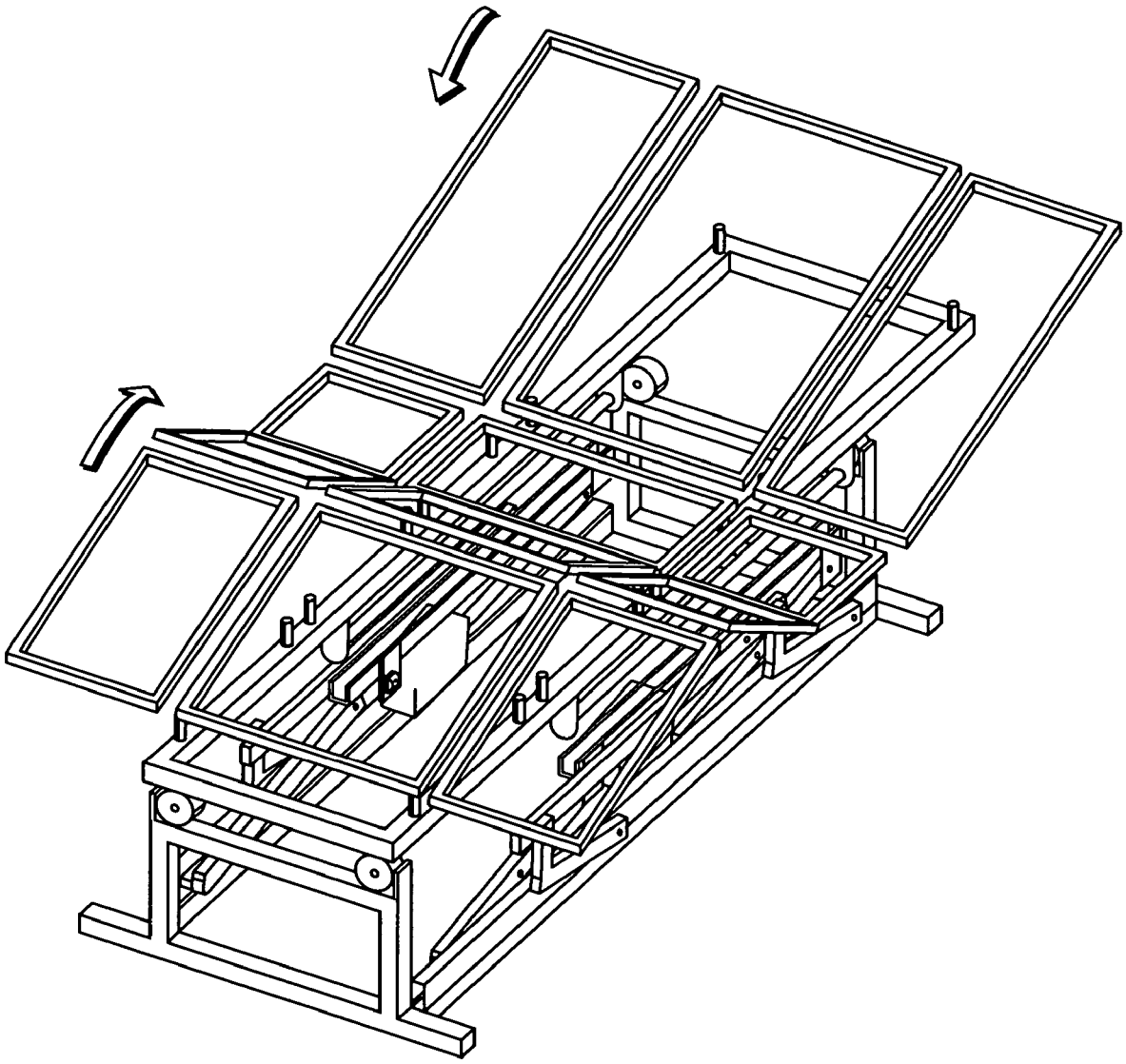
FIG. 9 is a perspective view of the turning bed (flexion position)
Figure 10:
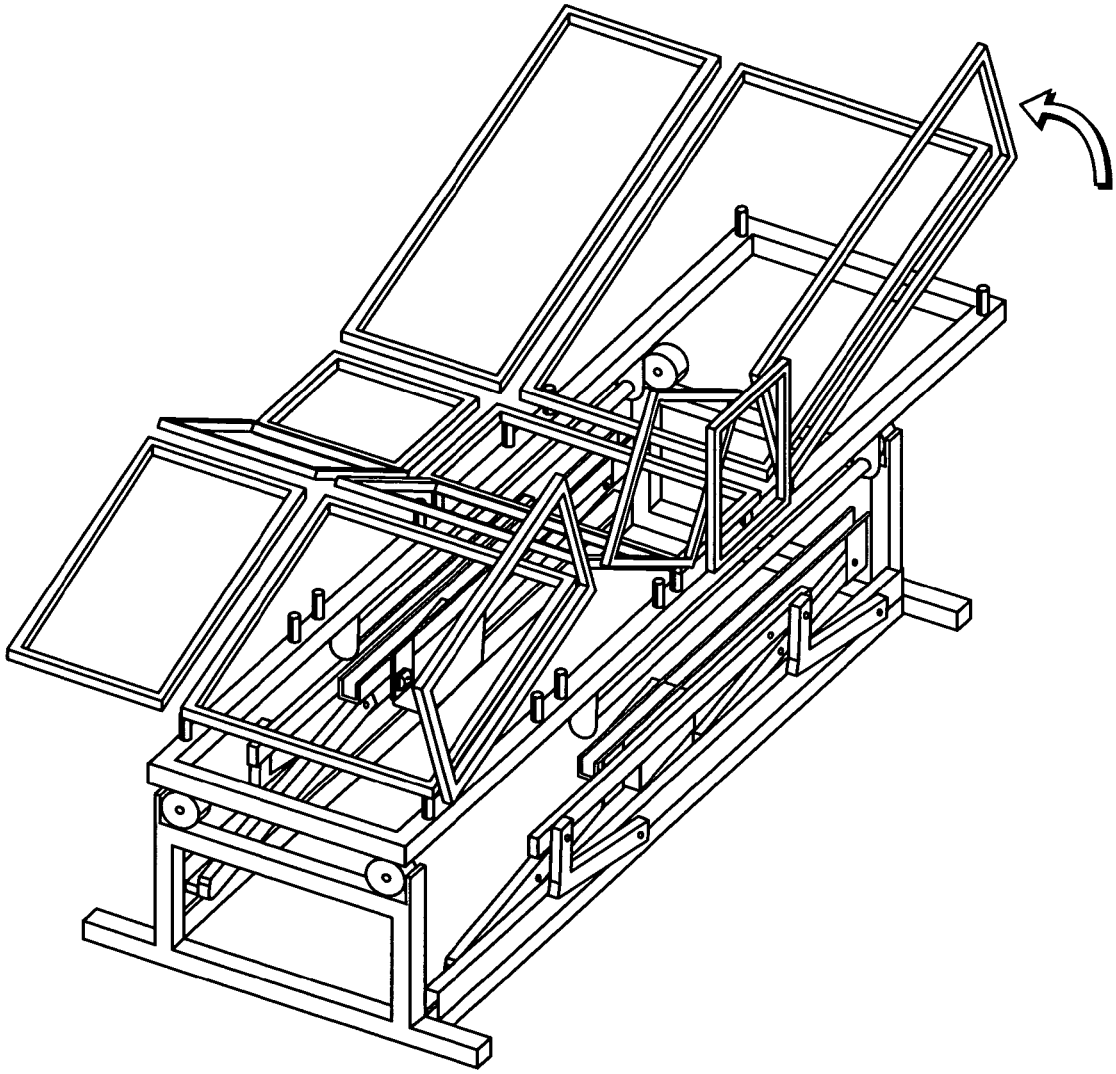
FIG. 10 is a perspective view of the turning bed (flexion position with left side raised)

In the above exemplary operation of embodiment 1, the care recipient is firstly placed in a Gatch position (i.e. semi-recumbent with knees elevated to prevent the care recipient from sliding toward the foot of the bed) after raising one set of side members (i.e. 12Ra-12Rd or 12La-12Ld), and then shifted from a supine to a lateral position. However, the present invention is not limited to this configuration. For example, a drive sequence may be employed in which the Gatch position is firstly obtained, as shown in FIG. 9, after which one set of side members is raised (see FIG. 10, for example), and then posture changed from a supine to a lateral position.

Since the posture of the care recipient according to this drive sequence is changed from the supine position after first obtaining a semi-recumbent position, it is possible to avoid any psychological anxiety, such as the claustrophobic feeling of being hemmed in, that may be caused by one set of side members suddenly being raised when the bed is driven, effectively narrowing the space around the care recipient when still in the supine position. Postural changes can thus be performed with minimum discomfort.

Furthermore, when, for example, posture is changed to a right lateral position after firstly obtaining a left lateral position, it is possible according to this operation sequence to perform these postural changes continuously from the left to the right while maintaining the flexion position (i.e. without first needing to return bed frame 10 to a horizontally flat state). Consequently, turning from a left to a right (or right to left) lateral position can be performed with the care recipient kept in a semi-recumbent position, thus allowing postural changes to be performed with minimum discomfort.

1-3-2. Side-Member Pressure Release Control

While the operations of turning bed 1 are fundamentally designed with the care recipient's safety in mind, the care recipient may feel tightly constrained by the raised set of side members (i.e. 12Ra-12Rd or 12La-12Ld). Such feelings can be alleviated by performing a control to slightly release the raised set of side members after the postural change is completed.

Figure 11:
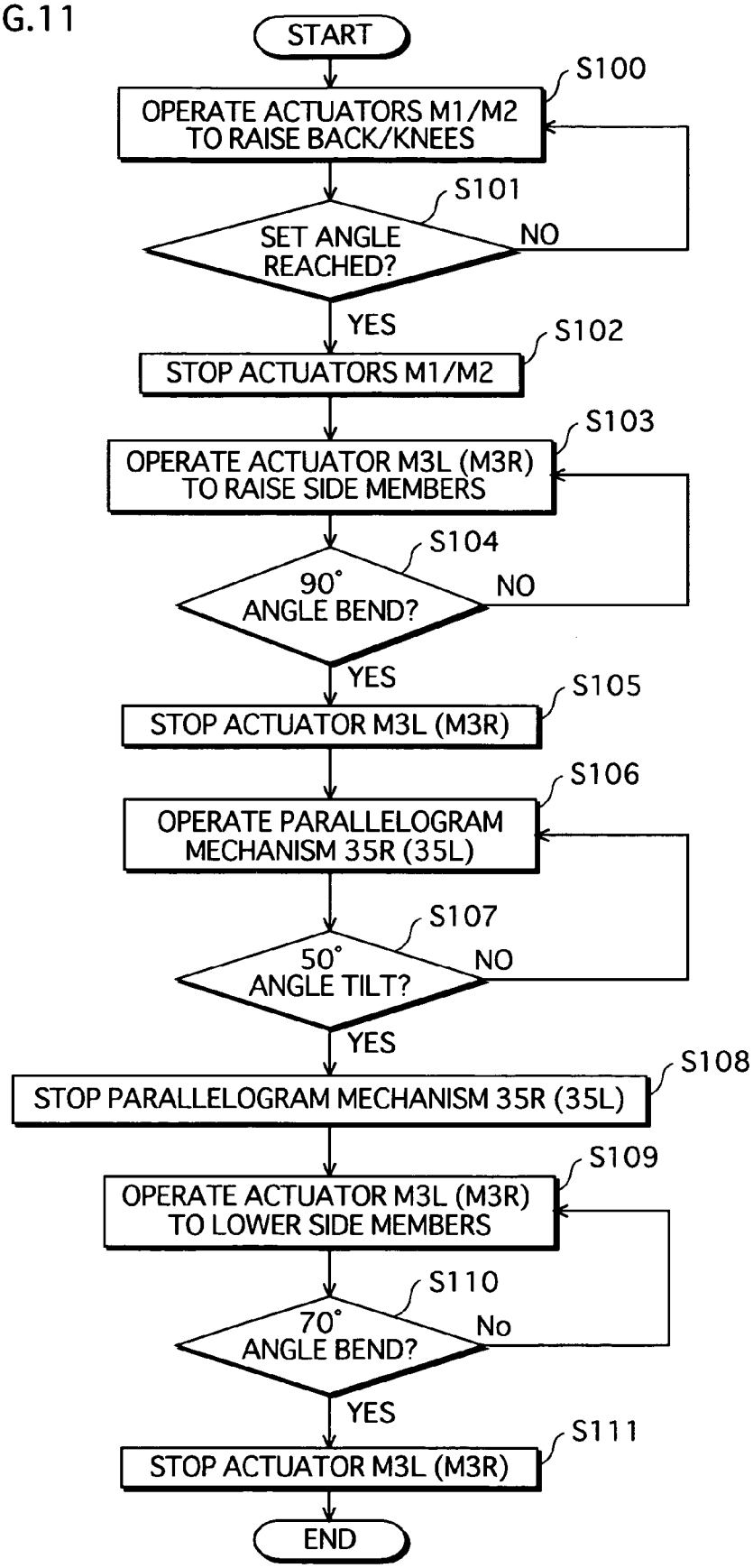
FIG. 11 is a flowchart of a side-member pressure release control.

FIG. 11 is an exemplary flowchart relating to a side-member release control for alleviating the feeling of being constrained. According to the exemplary control shown in FIG. 11, actuators M1 and M2 are firstly operated in order to obtain the Gatch position with back and knees raised (step 100), actuators M1 and M2 being operated continuously until a predetermined angle is reached (step 101). Then, after stopping actuators M1 and M2 (step 102), actuator M3R or M3L is operated in order to elevate side members 12Ra-12Rd or 12La-12Ld (step 103), actuator M3R or M3L being operated continuously until side members 12Ra-12Rd or 12La-12Ld are angled at 90 degrees (step 104). Then, after stopping actuator M3R or M3L (step 105), parallelogram mechanism 35R or 35L is operated in order to tilt adjustable stage 20 (step 106), this being continued until adjustable stage 20 is tilted at a 50-degree angle (step 107), the drive being stopped at this exemplary tilt angle of 50 degrees (step 108). Here, actuator M3R or M3L is operated so as to release whichever of side members 12Ra-12Rd or 12La-12Ld are bearing the weight of the care recipient (step 109), the tilt of side members 12Ra-12Rd or 12La-12Ld being returned from an angle of 90 degrees to 70 degrees (step 110). The angle here is not limited to 70 degrees, and may be any angle capable of supporting the care recipient's body. The operation of actuator M3R or M3L is stopped when an appropriate angle is achieved, and the release control ended.

Note that it is possible to perform the operations to obtain the Gatch position and elevate the side members in the opposite order to that described above.

1-3-3. Sync Control

The description here relates to an exemplary operation sequence for operating the side members and parallelogram mechanisms in synchronization. Since the sync control sequence enables the above two separate operations to be performed at the same time, it is possible, in addition to achieving time reductions, to shift the care recipient's weight smoothly from the coupled platforms to the side members, and thus to reduce any psychological burden on the care recipient that accompanies postural changes.

Figure 12:
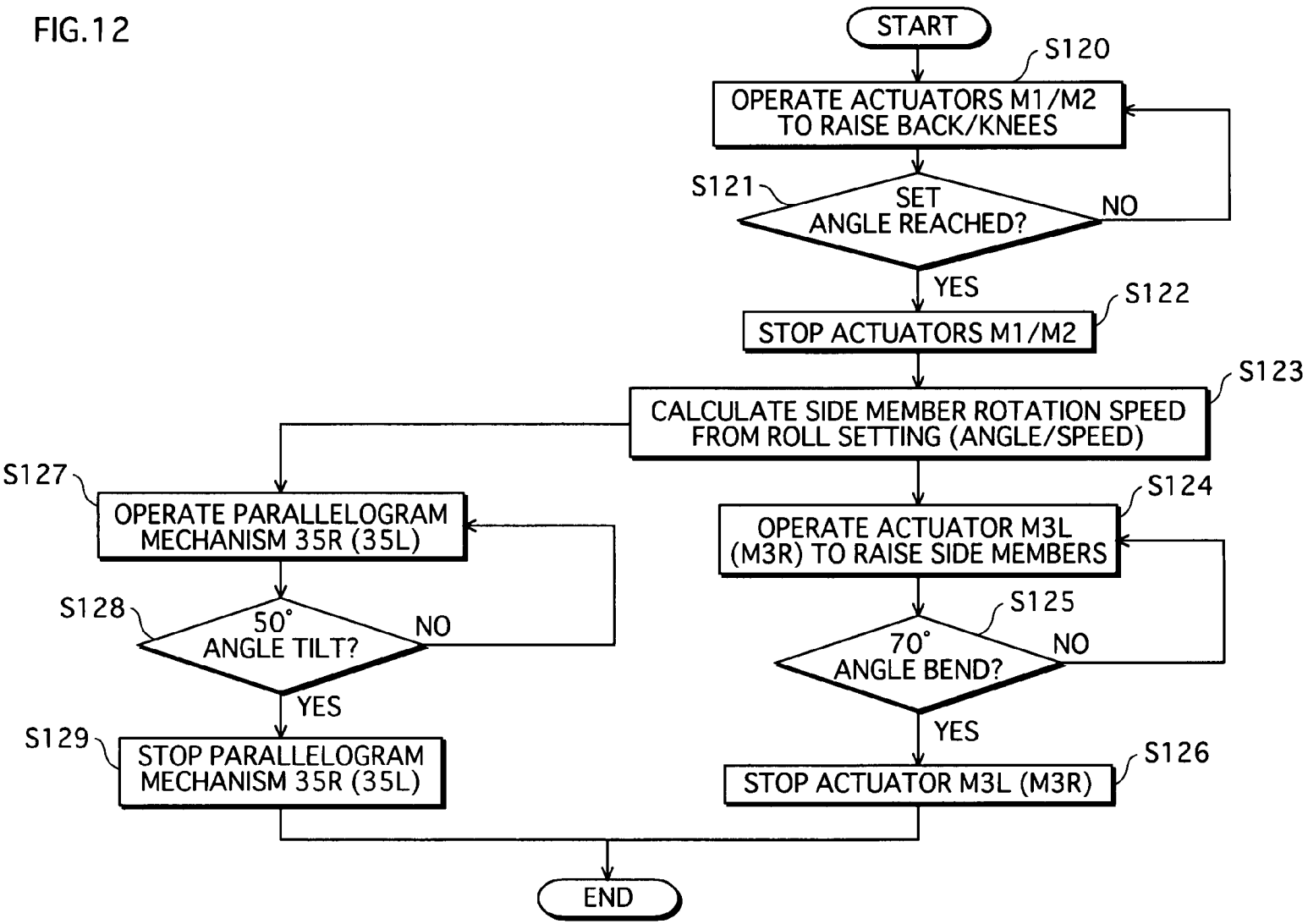
FIG. 12 is a flowchart of a middle/side member sync control.

FIG. 12 is a flowchart relating to this sync control sequence. According to the exemplary control shown in FIG. 12, actuators M1 and M2 are firstly operated so as to obtain the Gatch position (step 120), actuators M1 and M2 being operated continuously until a predetermined angle is reached (step 121). Then, after stopping actuators M1 and M2 (step 122), CPU 601 calculates the rotation speed of side members 12Ra-12Rd or 12La-12Ld relative to a horizontal direction, from a roll setting (i.e. adjustable stage 20 tilt angle, parallelogram mechanism 35R/35L operation speed) when parallelogram mechanism 35R or 35L is operated (step 123). Here, CPU 601 calculates the rate of change of the tilt angle of adjustable stage 20 and the rate of change of the tilt angle of side members 12Ra-12Rd or 12La-12Ld relative to platforms 11*a*-11*d*. Based on the calculated rates of change, actuator M3R or M3L is then operated so as to elevate side members 12Ra-12Rd or 12La-12Ld (step 124), and parallelogram mechanism 35R or 35L is operated at the same time (step 127). When the angles of side members 12Ra-12Rd (or 12La-12Ld) and parallelogram mechanism 35R (or 35L) reach 70 degrees and 50 degrees, respectively, while performing this sync driving, actuator M3R (or M3L) and parallelogram mechanism 35R (or 35L) are stopped and the sync control ended.

1-4. Turning Bed Safety Mechanisms

The description here relates a number of embodiments for enabling a turning bed of the present invention to be used safely.

1-4-1. Safety Mechanism Using Load Sensor (1)

Figure 13:
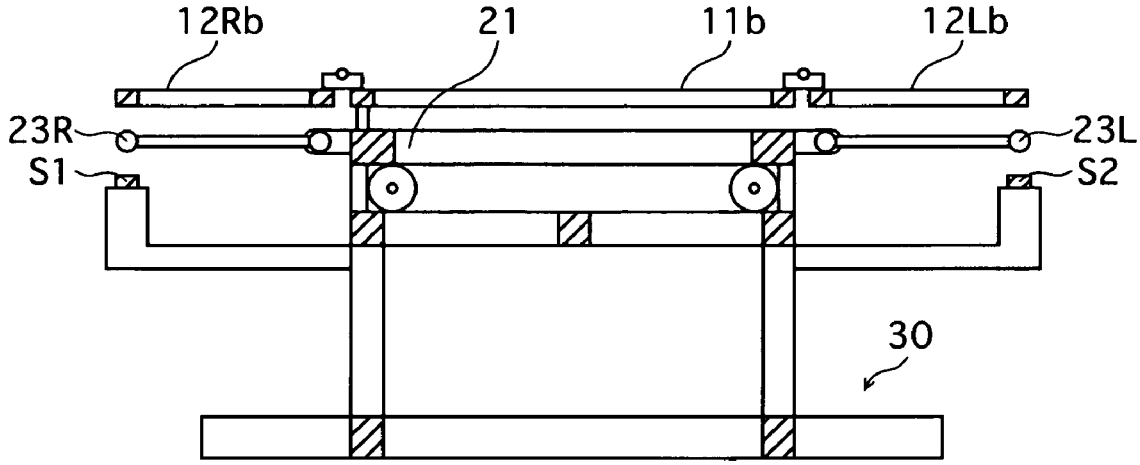
FIG. 13 shows a deployment of side-member load sensors.
Figure 14A:
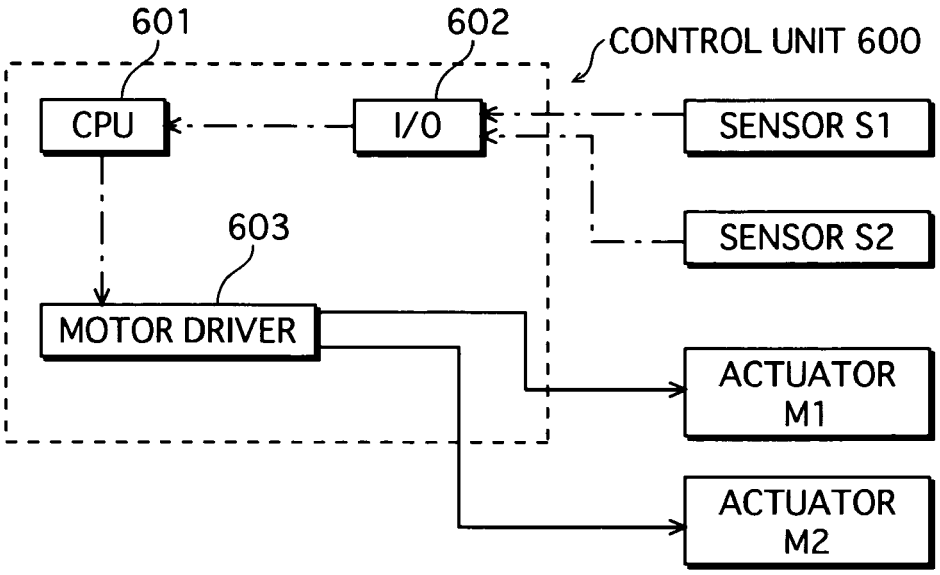
FIGS. 14A & 14B are respectively a block diagram of a control unit and a flowchart of a safety control.

FIG. 13 is a sectional view of the turning bed. As shown in FIG. 13, support arms (L-shaped cross-section) supported by fixed stage 30 are provided below bars 23R/23L, and load sensors S1 and S2 consisting of a micro switch are disposed on sections of the support arms facing bars 23R/23L. The state of load sensors S1 and S2 (transmit detection signals showing respective ON/OFF states) are, as shown in the FIG. 14A block diagram, managed by CPU 601 via an input/output (I/O) circuit 602 in control unit 600. When load sensors S1 and S2 are turned ON via bars 23R and 23L by the placement of a load on side members 12Rb/12Lb (i.e. when the care recipient's body is positioned over side members 12Rb/12Lb), CPU 601, as a safety measure, instructs motor driver 603 to stop the driving of actuators M1 and M2, and holds the turning operation in an OFF state.

Note that it is possible to position the sensors to correspond with any of side members 12Ra-12Rd and 12La-12Ld. Also, bars 23R/23L may be replaced members having flexible, springy properties.

Figure 14B:
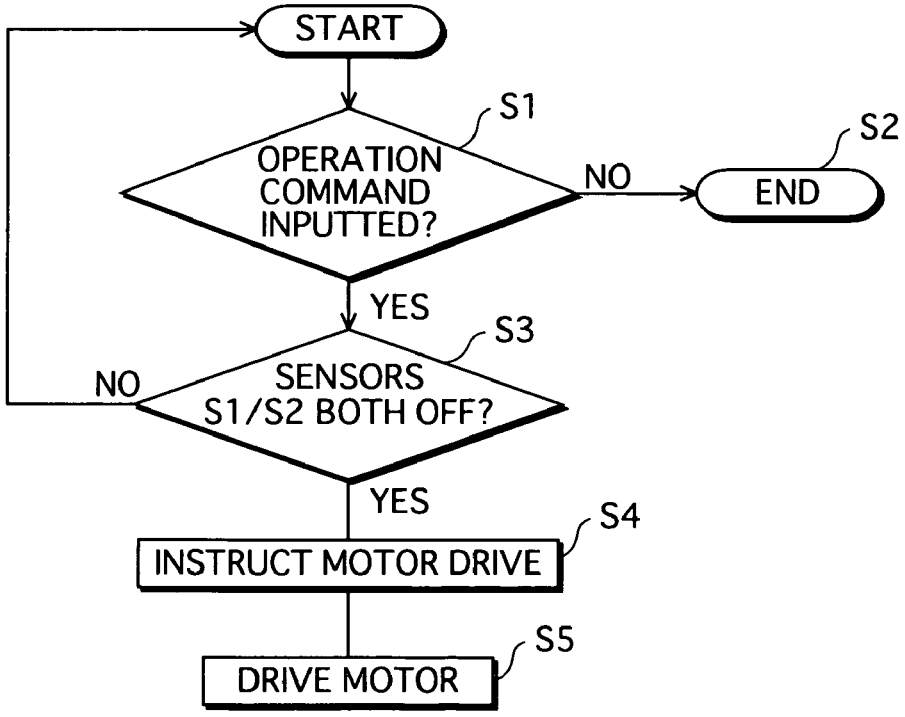

FIG. 14B is a flowchart of a specific control relating to the above safety mechanism. With the exemplary control shown in FIG. 14B, CPU 601 firstly judges whether a command relating to a postural change operation has been inputted (i.e. bed has been turned ON) from the controller (step 1). If the bed has been turned ON, CPU 601 then judges at step 3 whether the detection signal from load sensors S1 and S2 both show the sensors to be OFF (i.e. judgment as to whether a load is placed over side members 12Rb and 12Lb). If the sensors are OFF, CPU 601 instructs motor driver 603 to drive the motors of actuators M1 and M2 (step 4), and the motors of actuators M1 and M2 are driven based on this instruction (step 5).

Note that sensors other than micro switches may be applied in the load sensors an example of which is a device using a piezoelectric element.

Furthermore, although CPU 601 is described in the above example as controlling motor driver 603 to stop the driving of actuators M1 and M2, the present invention is not limited to this configuration. The present invention may be structured so that the turning operations are turned OFF using circuitry when load sensors S1 and S2 are OFF.

1-4-2. Safety Mechanism Using Load Sensor (2)

Figure 15:
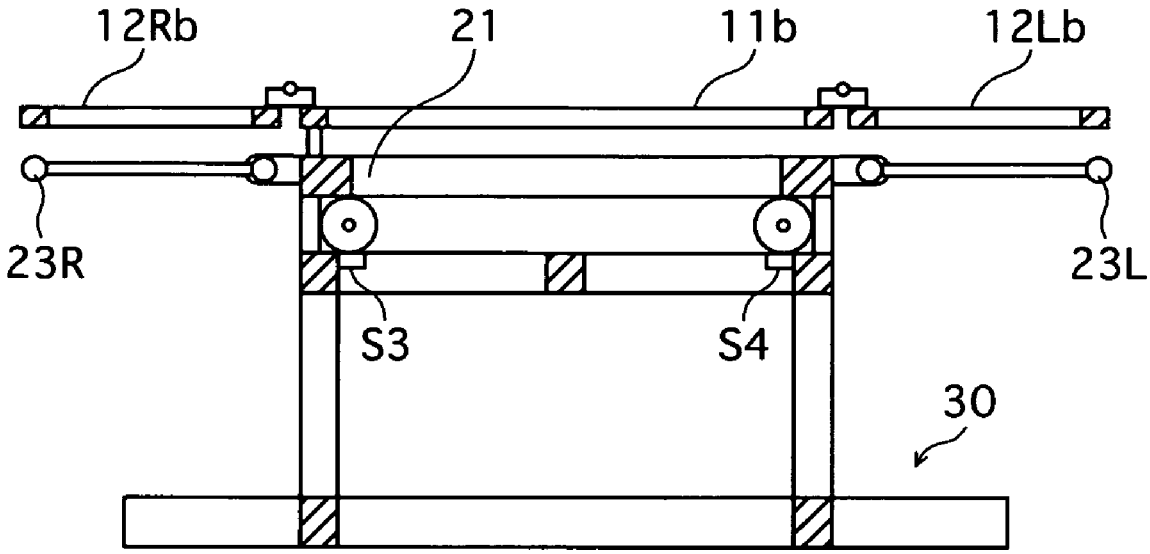
FIG. 15 shows a deployment of horizontal sync sensors.
Figure 16A:
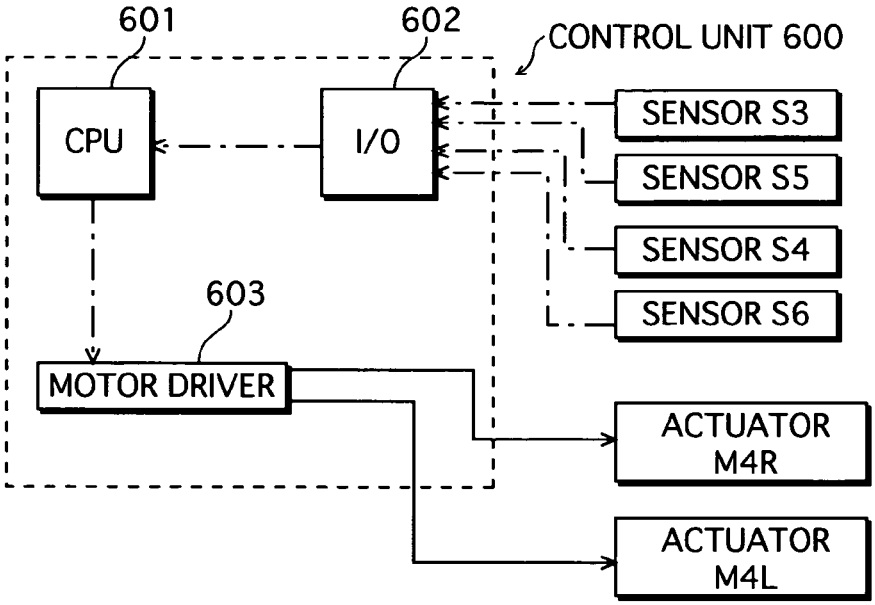
FIGS. 16A & 16B are respectively a block diagram of a control unit and a flowchart of a safety control.

FIG. 15 is a sectional view of the turning bed. As shown in FIG. 15, load sensors S3, S4, S5 and S6 (S5/S6 not depicted) consisting of micro switches are disposed between rollers 200-203 of adjustable stage 20 and roller track frames 300 of fixed stage 30. Detection signals (ON/OFF) of load sensors S3-S6 are, as shown in the FIG. 16A block diagram, managed by CPU 601 via I/O circuit 602 in control unit 600. Under normal conditions, load sensors S3-S6 are ON when in contact with adjustable stage 20, and turned OFF when adjustable stage 20 is elevated during the drive of the bed. Load sensors S3-S6 are provided for the following reason.

Despite actuators M4R/M4L and the like being provided in parallelogram mechanisms 35R/35L implemented in the turning bed of embodiment 1, operational errors may exist in these actuators due to precision variations during manufacture. Mechanical errors may also exist in parallelogram mechanisms 35R and 35L themselves, including the possibility of an operational delay in one of the actuators when operating parallelogram mechanisms 35R/35L in sync to elevate platforms 11*a*-11*d* in a horizontal position, or the coupled platforms being tilted at an angle due to the operation of parallelogram mechanisms 35R/35L not been smooth. This may cause psychological anxiety to a user lying on the bed.

Load sensors S3-S6 are provided to suppress the occurrence of such problems. The following operations, for example, are possible according to this structure.

Figure 16B:
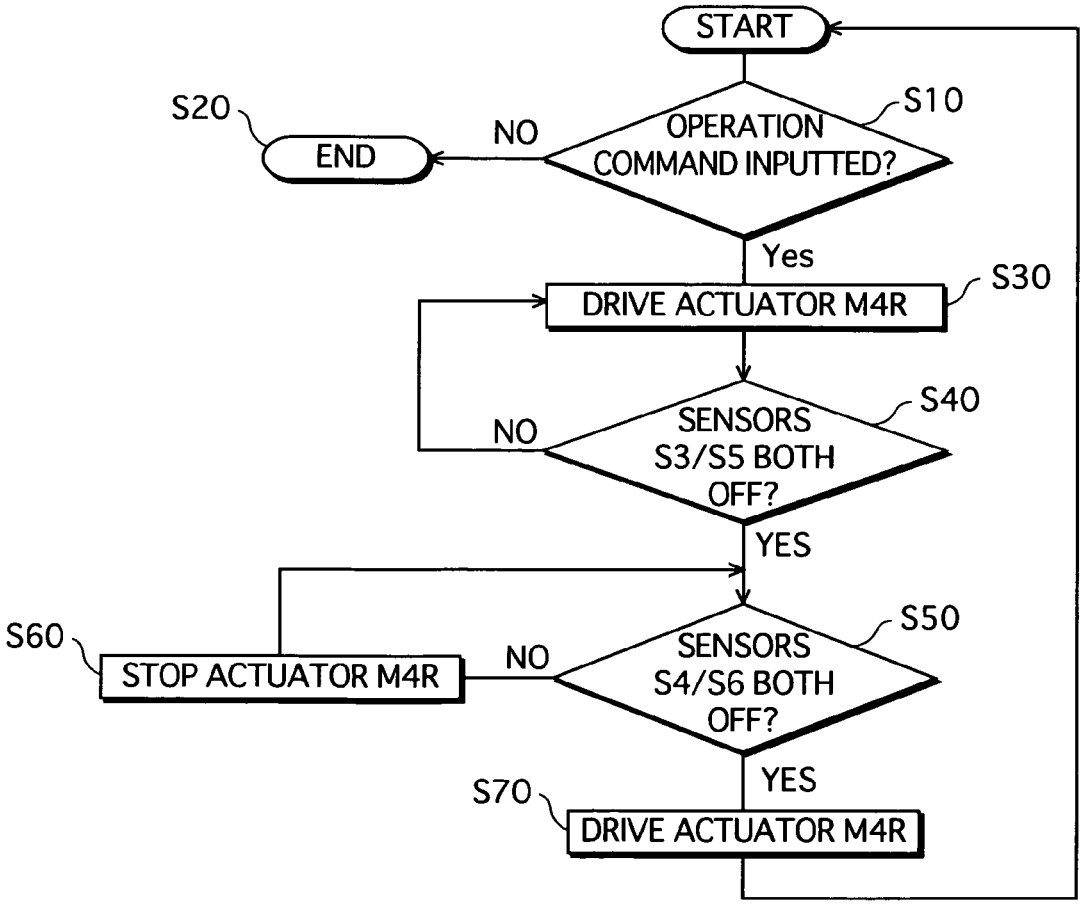

As shown in the FIG. 16B control flowchart, when the turning bed is driven, CPU 601 firstly judges at step 10 whether a postural change operation command ("Raise Bed" operation) has been inputted from the controller (i.e. bed has been turned ON). If the bed has been turned ON, CPU 601 drives actuator M4R (step 30). Note that actuator M4L is also driven at this time. Then, if the detection signals from load sensors S3 and S5 mounted on same side of the bed as actuator M4R show load sensors S3 and S5 to be ON (i.e. adjustable stage 20 resting on fixed stage 30), CPU 601 continues to drive actuator M4R, and when the detection signals show OFF (i.e. adjustable stage 20 elevated above fixed stage 30 on the right side of the bed), CPU 601 stops driving actuator M4R until the detections signal from load sensors S2 and S4 show OFF (step 50, 60). CPU 601 then restarts the driving of actuator M4R once all of load sensors S3-S6 are OFF. While this control flowchart relates to actuator M4L drive delays, the same control flowchart can, of course, also be used to respond to the case of actuator M4R drive delays.

As such, if the driving of parallelogram mechanism 35R commences prior to parallelogram mechanism 35L, for example, detection signals from the load sensors disposed on the same side as parallelogram mechanism 35R will show OFF. CPU 601, having acknowledged the OFF state of these load sensors, stops the operation of parallelogram mechanism 35R and drives parallelogram mechanism 35L. Then, once the detection signals from all of load sensors S3-S6 show OFF, CPU again drives parallelogram mechanism 35R. Thus, with the turning bed of embodiment 1, parallelogram mechanisms 35R/35L can be sync driven with greater precision and the bed elevated while maintaining an extremely flat bed surface, thereby reducing any psychological anxiety caused to the bed user.

Note that sensors other than micro switches may be applied in load sensors S3-S6, an example of which is a device using a piezoelectric element or the like.

Also, load sensors S3-S6 (micro switches) may be OFF when the bed is in a normal state and turned ON when adjustable stage 20 is elevated, CPU 601 judging the state of the load sensors on this basis. This configuration is most preferable in terms of providing a safe feel.

Furthermore, the present invention is not limited to the above exemplary provision of four load sensors S3-S6. The number of load sensors may be other than four, an example of which is the provision of one load sensor on the right and left sides at the head or foot of the bed.

1-4-3. Safety Mechanisms of Turning Bed

Figure 17:
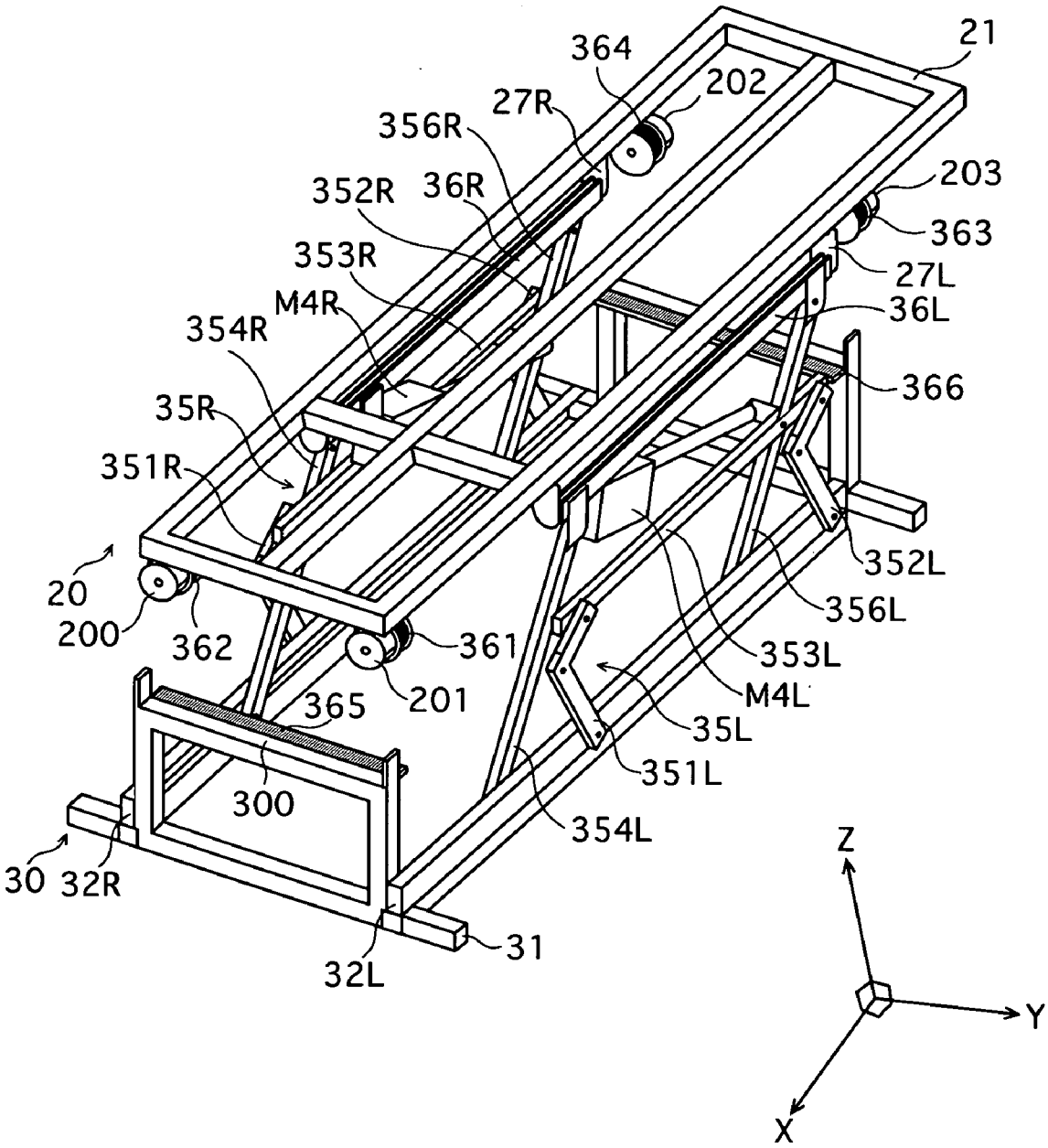
FIG. 17 shows an exemplary deployment of viscosity generating means (rotary dampers)

In the example shown in embodiment 1, rollers 200-203 roll along the top of roller track frame parts 300 and 301, although it is possible to provide viscosity-generating means corresponding to rollers 200-203, an example being so-called rotary viscous dampers, which are rotary-type speed controllers that use oil pressure (hydraulic). FIG. 17 shows an exemplary configuration in which rotary dampers 361-364 and racks 365 and 366 that mesh with the dampers are attached in a vicinity of rollers 200-203.

According to this configuration, control is exerted on the rotary action of rollers 200-203 by rotary dampers 361-364 mounted thereto when, for example, parallelogram mechanism 35R is operated during the driving of the turning bed, allowing for gentle and smooth rotation with a high degree of stability, and thus for turning operations to be performed safely.

Of course, the viscosity-generating means may be other than rotary dampers 361-364. For example, it is possible to employ rotation-speed controller mechanisms such as known friction clutch mechanisms or centrifugal brake mechanisms in same locations as rotary rollers 361-364. Also, rotary dampers 361-364 can be formed integrally with respective rollers 200-203.

1-5. Related Matters

In the example given in embodiment 1, the middle and side parts of the bed frame are each divided into four sections in a longitudinal direction, and these sections are coupled together. The present invention is, of course, not limited to this configuration, it being possible to divide the bed frame into a different number of sections. However, the platform, when structured from a coupled frame as in embodiment 1, preferably is divided into four or more sections corresponding to the upper body, lower back, and upper/lower leg regions, since this allows for subtle adjustment of the bed frame so as to at least accommodate postural changes when the care recipient is sleeping, for example.

Also, the side members may also be divided in the longitudinal direction (x direction) and the resultant sections linked together, thus allowing postural changes to be carried out while cradling the care recipient to provide support.

Furthermore, although direct-acting actuators are used in the example given in embodiment 1, other actuator drive methods may be used, an example of which is a rotational method. Also, other driving sources may be used, examples of which include actuators that operate using pneumatic or hydraulic methods, for example.

Furthermore, although the description in embodiment 1 only relates to postural changes from a supine to a left lateral position, it is, of course, possible to similarly perform postural changes in the opposite direction or from supine to right lateral positions.

Furthermore, turning bed 1 of embodiment 1 is not limited only to care recipients such as bedridden patients, and can also be used as a general-purpose bed.

Furthermore, since the mechanism consisting of coupled platforms 11*a*-11*d* and actuators M1 and M2 for obtaining a flexion position is disposed independently of parallelogram mechanisms 35R and 35L on either side of turning bed 1, it is also possible to drive these mechanisms selectively in order to separately raise the back/knees or tilt/elevate the bed surface.

Note that although in the embodiment 1 example, the controller of the turning bed was an infrared type or a cable/wireless type having a cord, the present invention is not limited to this configuration, it being possible to perform drive controls using speech recognition.

Figure 18A:
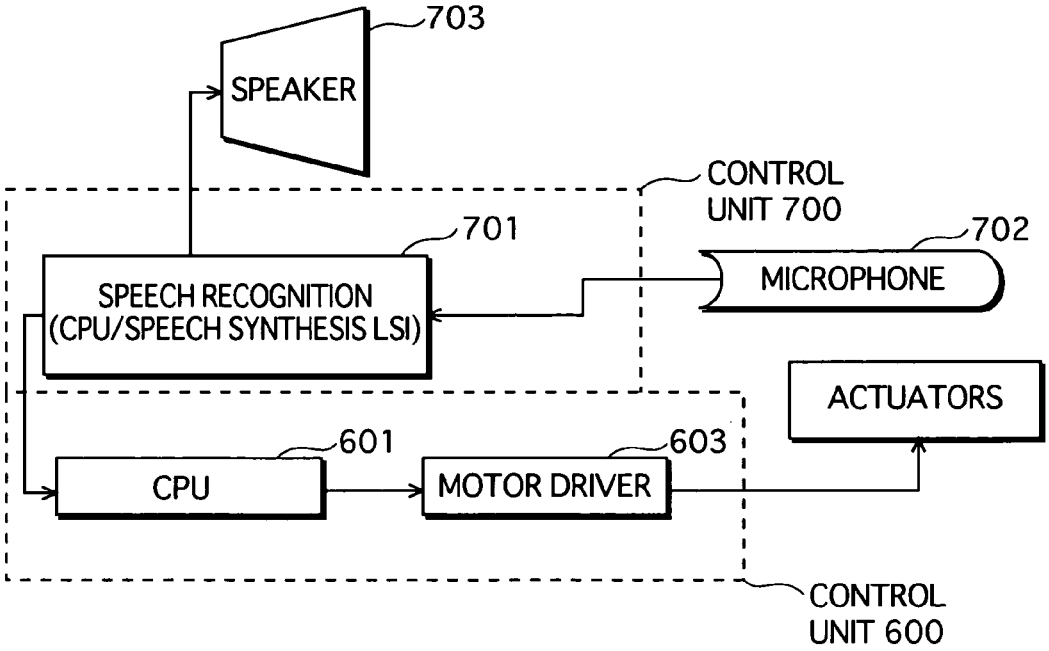
FIGS. 18A & 18B are respectively a block diagram of a speech recognition unit and a diagram showing an exemplary bed construction.

FIG. 18A is a block diagram showing a configuration for performing drive controls using speech recognition. The speech recognition unit, as one example, includes a microphone 702 as an input device and a speaker 703 as an output device, and is constituted from a control unit 700 that includes a speech recognition device 701 consisting of a single-chip microcomputer, and control unit 600 that includes CPU 601 and motor driver 603 for driving the actuators. Speaker 703 is provided for announcing operations to the bed user before the operations are performed. A predetermined number of vocabularies (e.g. "tilt to left", "raise head", etc) for instructing the various operations of turning bed 1 are prestored in a memory included in speech recognition device 701, and various operation instructions corresponding to these vocabularies are sent to CPU 601. Furthermore, words that reflect slight variations in pronunciation from the predetermined vocabularies are also supplementarily stored in memory, so as to enable speech recognition device 701 to respond when there are slight errors/differences in the inputted words (e.g. the instruction "lower head" being inputted as "lower 'ead" with the consonant "h" dropped), thus enabling operation that allows for such errors/differences.

Figure 18B:
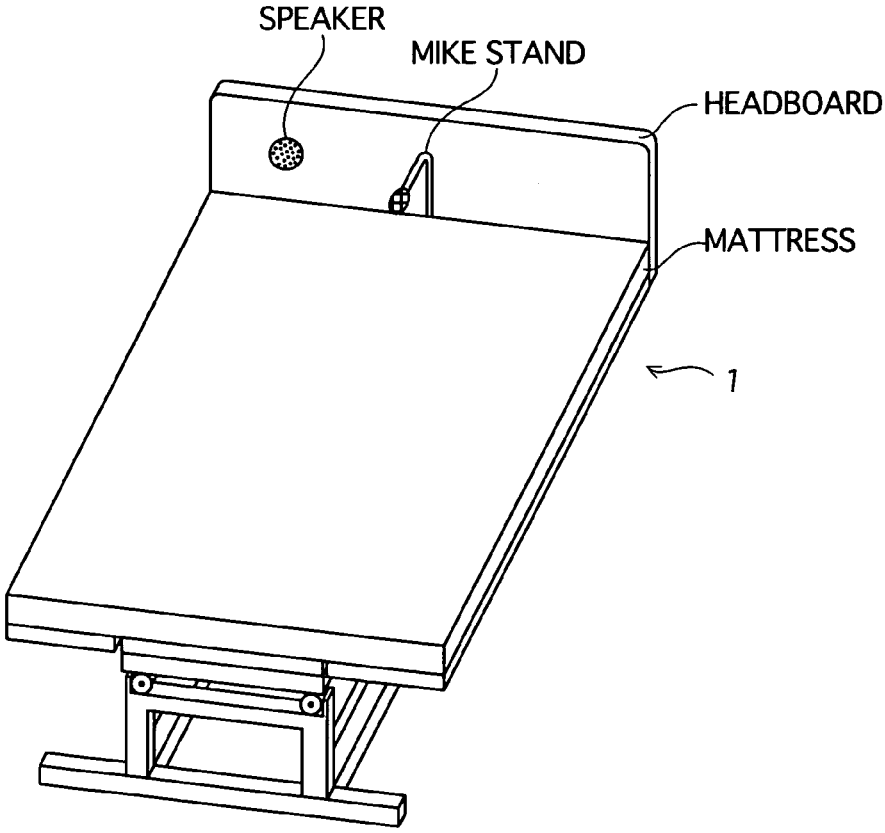

On the other hand, FIG. 18B is a perspective view of a turning bed having a microphone (speech recognition input device) attached thereto. Schematically shown in the present embodiment is a configuration in which platform 11*a* at the head of the bed, to which a headboard is fitted, is equipped with a microphone having a flexible stand. This allows the microphone to always be positioned close to the care recipient's mouth even when the bed is driven. Here, a lavalier microphone may be used in place of the microphone stand.

Figure 19:
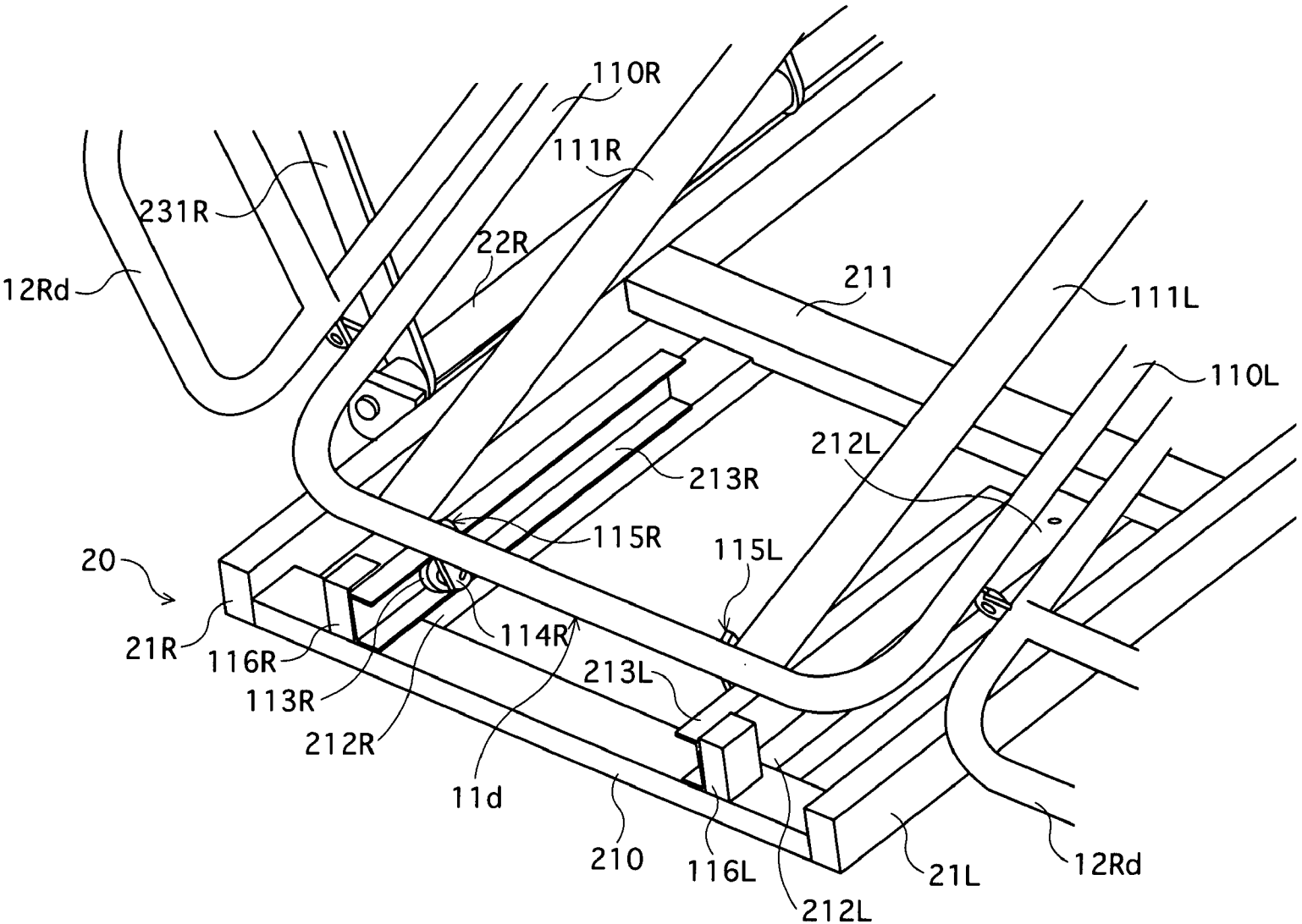
FIG. 19 shows a configuration of a platform stabilization mechanism.

FIG. 19 shows an exemplary structural improvement in a vicinity of platform 11*d*. Platform 11*d* and adjustable stage 20 shown in FIG. 19 are coupled together with slide-roller mechanisms 115R/115L provided therebetween. This effectively prevents any play between platform 11*d* and adjustable stage 20. Note that although the structure in a vicinity of platform 11*d* shown in FIG. 19 differs from that shown in FIG. 1, the fundamental structure of the bed is the same.

At the foot end of adjustable stage 20 shown in FIG. 19, side frame parts 21R/21L are fixed in place by two frame parts 210 and 211, which are in turn secured in place by frame parts 212R/212L. On platform 11*d* are disposed rollers 113R/113L, which are fitted into slide channels 213R/213L on frame parts 212R/212L so to travel back and forth within the channels.

Two frame parts 111R/111L are disposed on the inside of frame parts 110R/110L, which form the outer frame of platform 11*d*, and rollers 113R/113L are attached to frame parts. 111R/111L via triangular slide chips 112R/112L and roller stands 114R/114L. While rollers 113R/113L are normally (i.e. bed in horizontal position) removed from slide channels 213R/213L, when the bed is driven the sloped surface of slide chips 112R/112L comes in contact with slide blocks 116R/116L and rollers 113R/113L fit into slide channels 213R/213L. Slide chips 112R/112L and slide blocks 116R/116L are made from a hard resin material having favorable sliding properties.

Figure 20A:
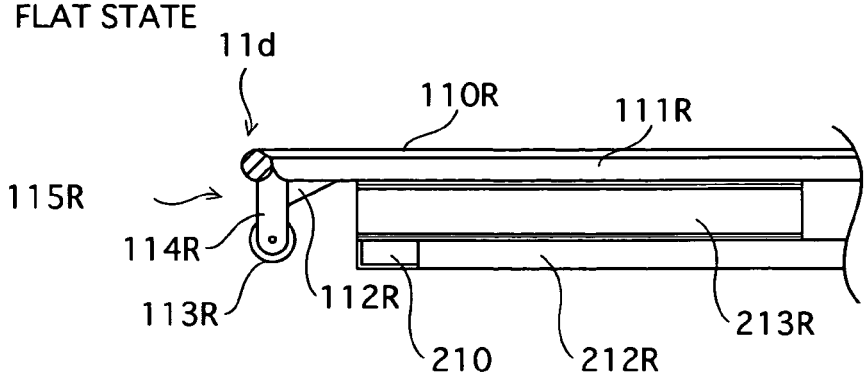
FIGS. 20A to 20D show movements of the platform stabilizing mechanism.
Figure 20B:
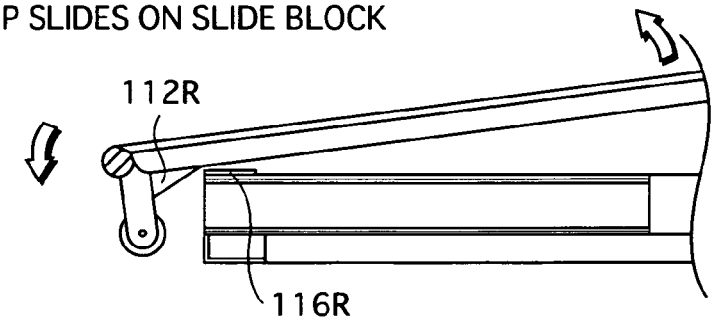
Figure 20C:
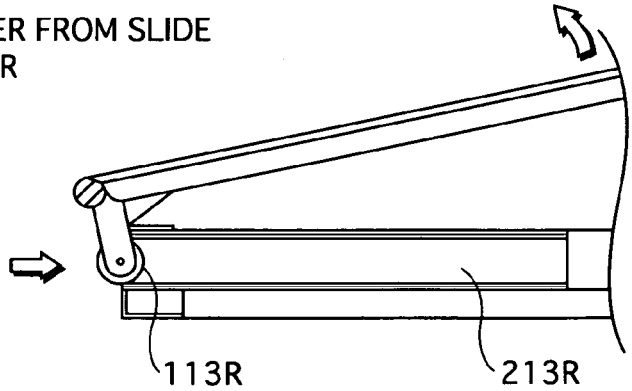
Figure 20D:
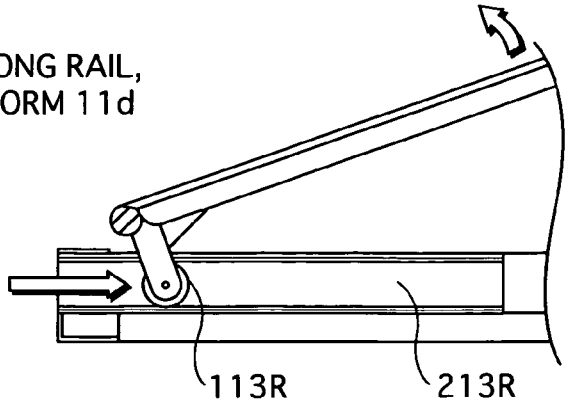

The operations when using the above slide roller mechanisms 115R/115L are as shown in the partial sectional views of the bed in FIGS. 20A-20D. Under normal conditions (i.e. horizontal bed), rollers 113R/113L are positioned freely outside of slide channels 213R/213L when forming a flat bed surface (FIG. 20A), and then as platform 11*d* inclines to form the Gatch position, the sloped surface of slide chips 112R/112L slide over slide blocks 116R/116L (FIG. 20B). As the slope of platform 11*d* becomes steeper, rollers 113R/113L fit into slide channels 213R/213L with the sloped surface of slide chips 112R/112L being guided by slide blocks 116R/116L. The load bearing thus shifts from slide chips 112R/112L to rollers 113R/113L (FIG. 20C). Rollers 113R/113L then slide along slide channels 213R/213L, allowing a favorable Gatch position to be formed without platform 11*d* suddenly separating from fixed stage 20 (FIG. 20D).

Accordingly, slide roller mechanisms 115R/115L may be provided in the present invention to stabilize bed operations.

1-6. Turning Bed Mattress

Described here is an exemplary construction of a mattress suitable for use with a turning bed as described above.

1-6-1. Mattress formed from Composite Material

Figure 21:
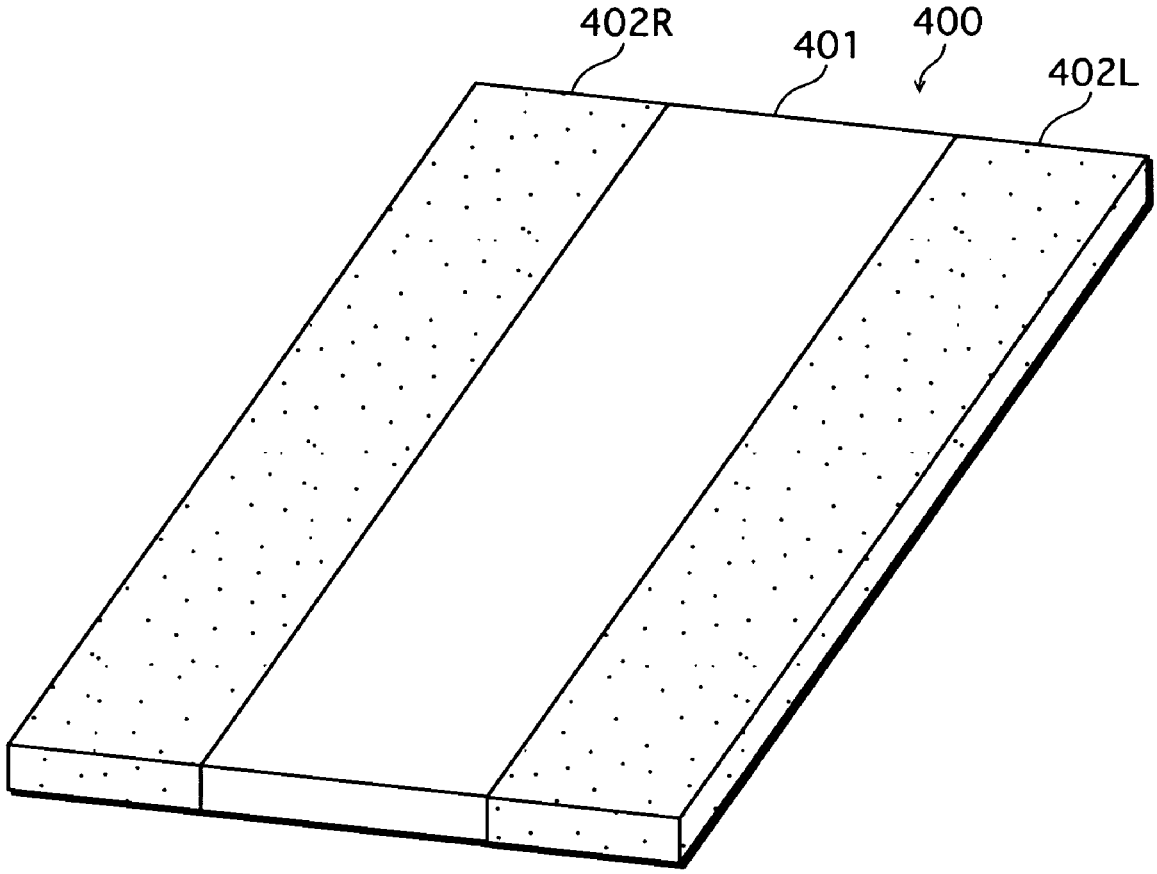
FIG. 21 shows an exemplary construction of a turning bed mattress formed from a composite material.

FIG. 21 shows an exemplary construction of a turning bed mattress. Mattress 400, which is basically made from a urethane material, has a hybrid structure formed from a composite material in which a relatively soft material is used for a section 401, which corresponds to platforms 11*a*-11*d* of the turning bed, and a relatively hard material used for sections 402R/402L, which correspond to side members 12Ra-12Rd/12La-12Ld.

By using mattress 400 having this construction, it is firstly possible to support the posture of a care recipient lying horizontally on the mattress using section 401 of the mattress surface made from the relatively soft material. Secondly, when the bed is driven, the care recipient can expect postural changes to be performed while being gently supported, as a result of sections 402R/402L of the mattress surface being made from the relatively hard material giving to fit the shape of the side of the body.

1-6-1. Mattress with Alignment Mark

Figure 22:
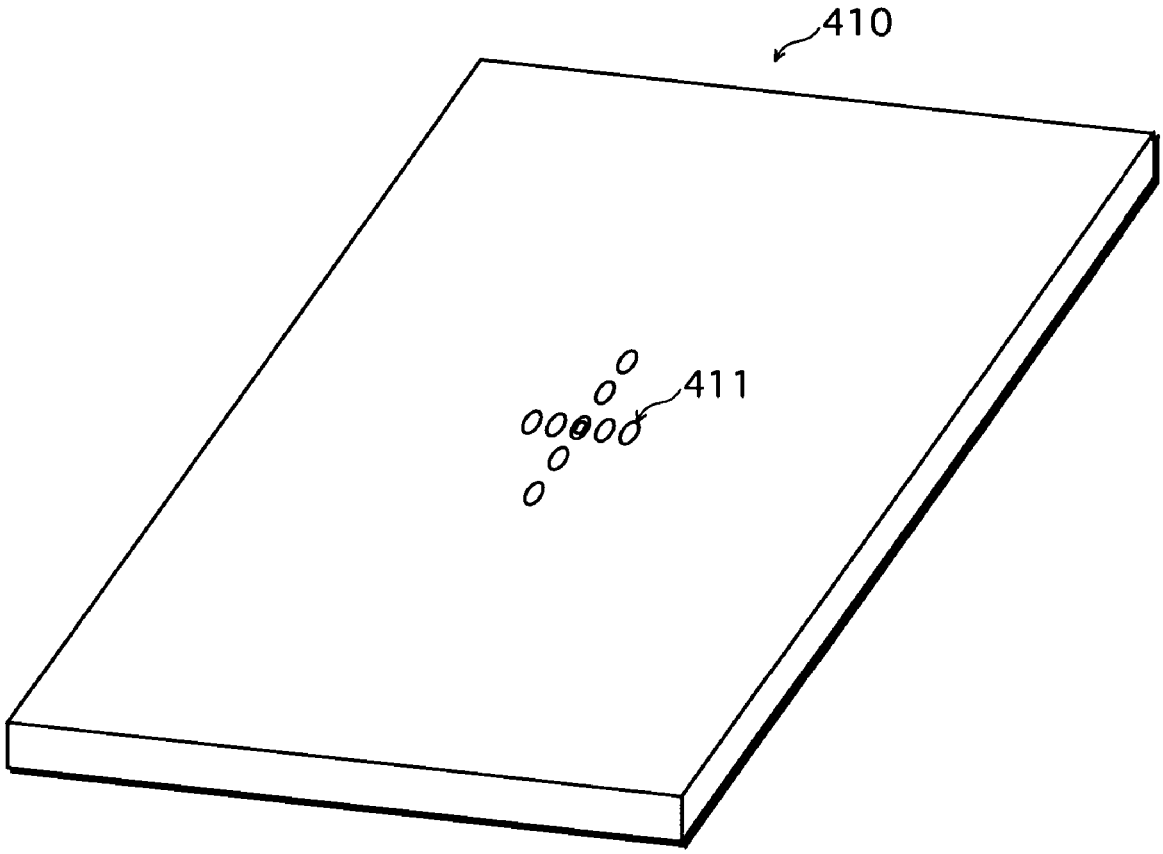
FIG. 22 shows an exemplary construction of a turning bed mattress having an alignment mark.

FIG. 22 shows an exemplary construction of a turning bed mattress. On a surface of mattress 410 is disposed an alignment mark 411 in the shape of a cross that marks a position corresponding to the care recipient's buttock region, thus enabling the care recipient to lie in an optimal position. Alignment mark 411 may be printed, embroidered, or the like on the mattress. This additional measure results in a turning bed of the present invention capable of performing even safer and more effective postural changes. The pattern of alignment mark 411 may, of course, be other than that shown in FIG. 22. Also, an alignment mark may be printed on a mattress sheet or the like.

1-6-3. Mattress having Slits

Figure 23A:
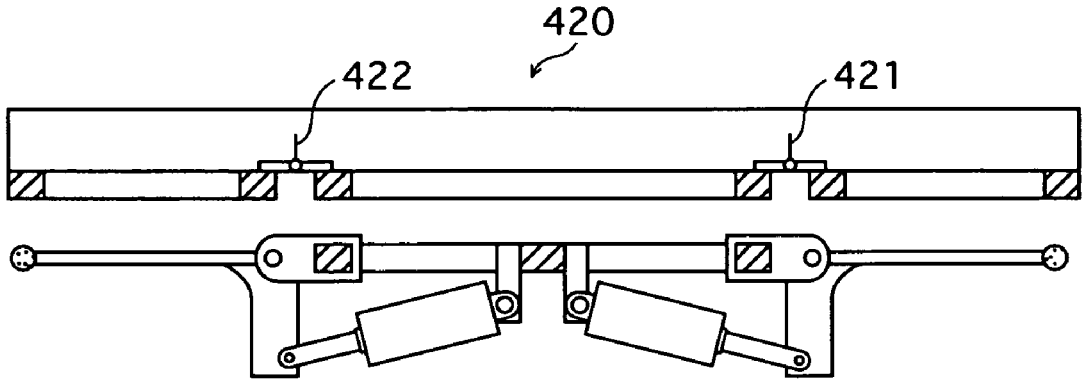
FIGS. 23A & 23B show a construction of a turning bed mattress having slits.
Figure 23B:
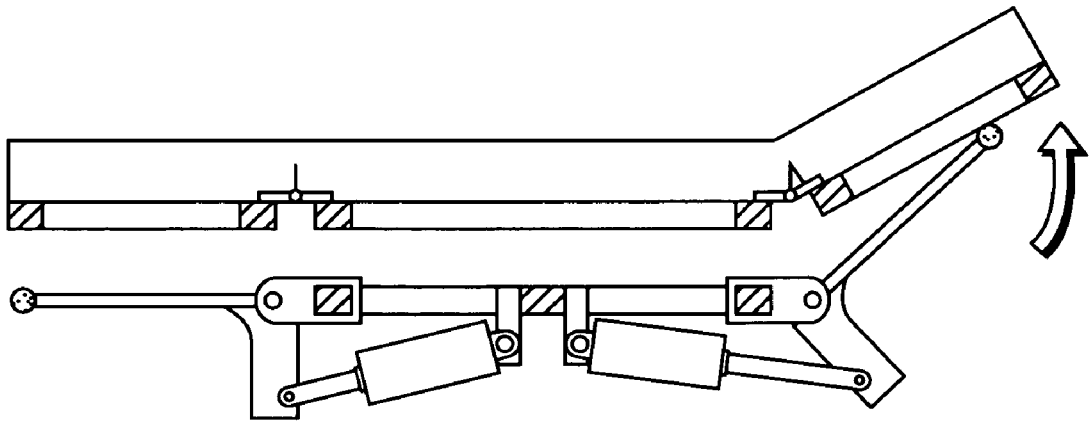

FIGS. 23A and 23B are sectional views showing an exemplary construction of a turning bed mattress. As shown in these diagrams, mattress 420 has slits 421 and 422 formed in a thickness direction thereof, the position of the slits corresponding to the joints coupling platforms 11 to side members 12R/12L.

According to this construction, slits 421 and 422 in mattress 420 open up when side members 12R or 12L are raised, forming a mattress surface having a natural slope by smooth operations, and facilitating postural changes.

1-6-4. Mattress having Hooks

Figure 24:
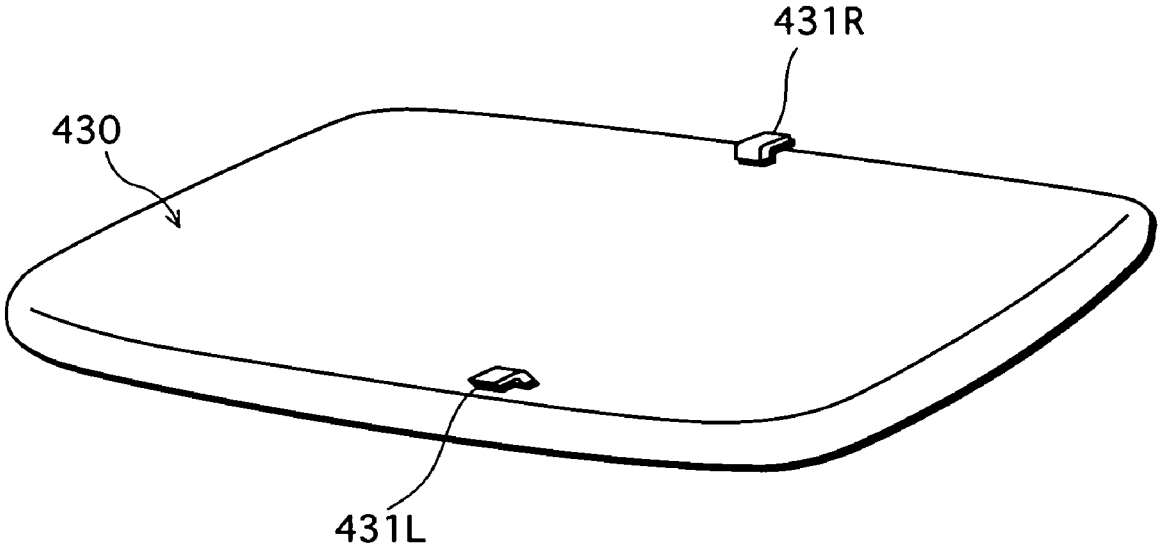
FIG. 24 shows an exemplary construction of a turning bed mattress having fixed implements.

FIG. 24 shows an exemplary construction of the underside of a turning bed mattress. A characteristic of mattress 430 shown in this diagram is the attachment of hooks 431R/431L on both sides of the mattress at positions corresponding to the knee region (i.e. side members 12Rc/12Lc) when the care recipient is lying down, these hooks being designed to mate with the meshed surface of side members 12Rc/12Lc.

Since the sides of mattress 430 are secured to the surfaces of side members 12Rc/12Lc according to this construction, problems arising from the movement of platforms 11*a*-11*d* and side members 12Ra-12Rd/12La-12Ld when the bed is driven, such as the mattress being pinched between the joints of bed frame 10, are favorably avoided, thus making it possible to suppress operational errors and perform smooth postural changes.

While hooks 431R/431L may be provided at positions other than the edge of mattress 430, the positions shown in FIG. 24 are preferable since they most effectively prevent pinching of the mattress. Also, hooks 431R/431L may be provided on a sheet or the like covering mattress 430, rather than directly on mattress 430. Since sheets are more likely to get pinched than mattress 430, this configuration makes it possible to effectively resolve problems relating to pinching.

2. Embodiment 2

Figure 25A:
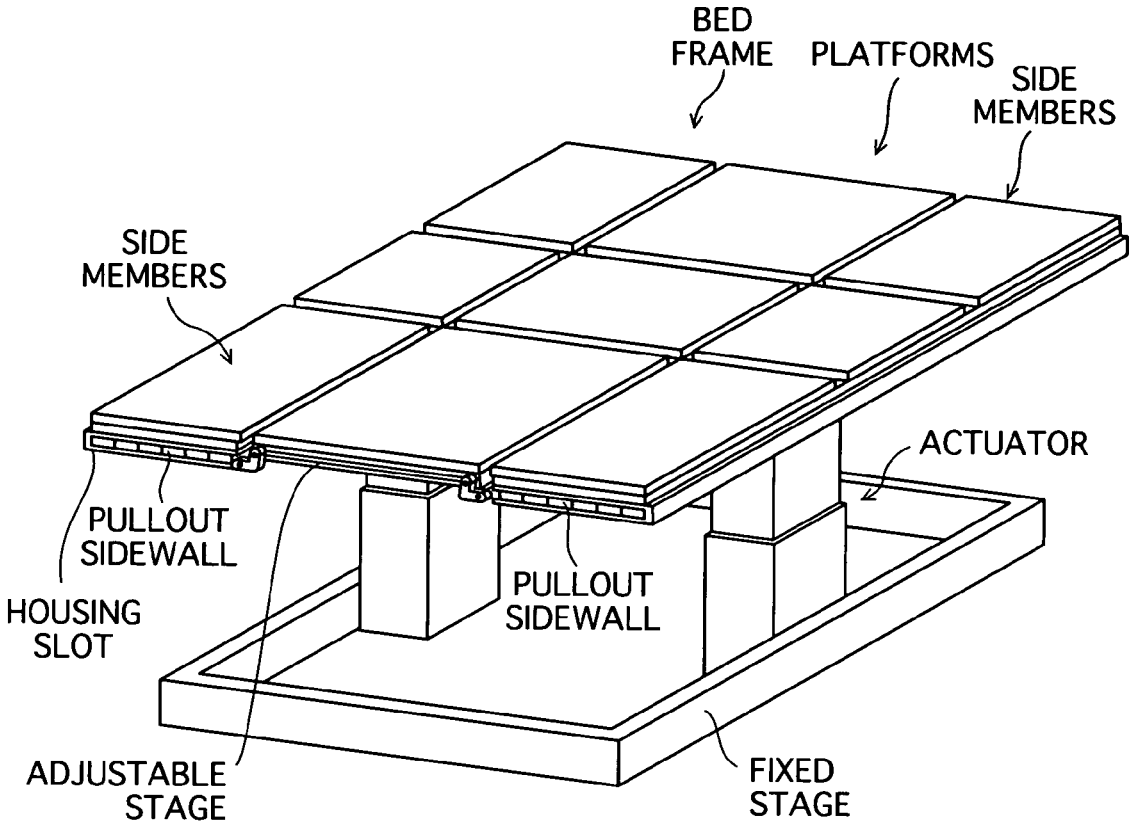
FIGS. 25A & 25B are perspective views of a turning bed in an embodiment 2.

FIG. 25A is a perspective view showing a structure of a turning bed in an embodiment 2.

While the bed structure in embodiment 1 is driven using parallelogram mechanisms, in embodiment 2, direct-acting actuators are disposed vertically, and side members on the left or right are elevated vertically using elevation mechanisms, thus enabling platforms positioned above an adjustable stage to be titled.

With the turning bed of embodiment 2, a pair of columnar direct-acting actuators is disposed within a rectangular fixed stage, and a bed frame supported by an adjustable stage is positioned on top of the actuators. The platforms, as in embodiment 1, are constructed as coupled platforms that are coupled together by a plurality of joints corresponding to the care recipient's upper body, hip, upper leg, and lower leg regions. Of these, the section corresponding to the upper-leg board is secured to the adjustable frame, which has a frame construction equivalent to the overall size of the platforms. Provided on the underside of the platforms is a drive unit that includes an actuator mechanism for forming a flexion position.

Side members are disposed above the columnar direct-acting actuators. Housing slots are formed in the side members. Here, the housing slots are partitioned in a longitudinal direction of the bed, and pullout sidewalls that are coupled to one another are housed in the housing slots. The side members are coupled to the adjustable stage supporting the platforms via the pullout sidewalls. The pullout sidewalls are biased in the direction of the housing slots by tension springs or the like, and are automatically housed in the housing slots when a force pulling the pullout sidewalls out of the housing slots weakens.

Figure 25B:
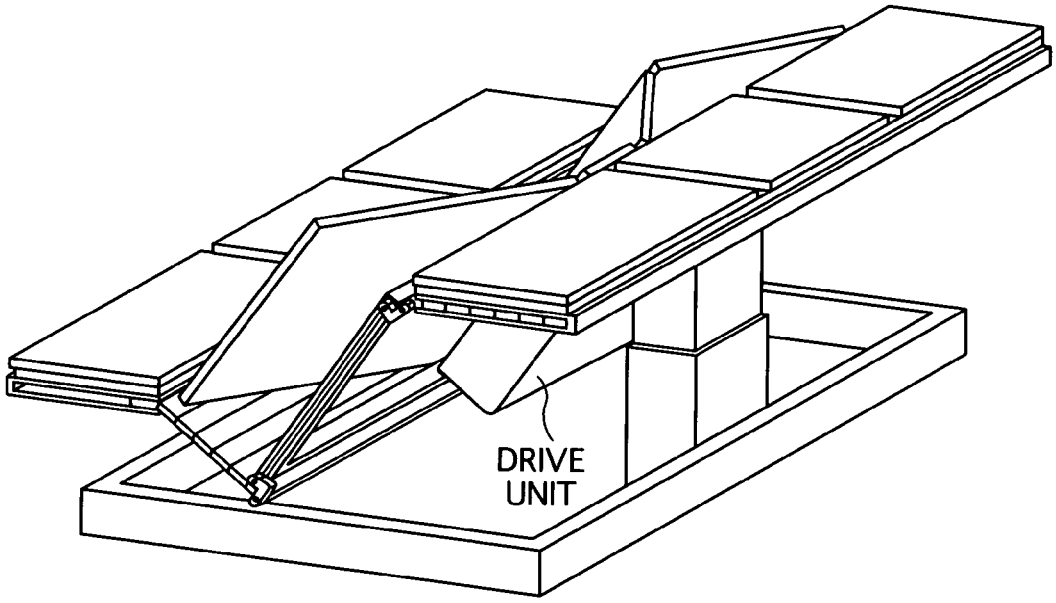

With a turning bed having the above structure, a flexion position is firstly formed using the coupled platforms when the bed is driven, as shown in FIG. 25B. One of the columnar direct-acting actuators then operates to lower the set of side members positioned thereabove. This has the effect of tilting the adjustable stage, which also brings the coupled platforms down at an angle. This results in the pullout sidewalls being pulled toward the coupled platforms from the respective housing slots at the lowered end of the tilted adjustable stage, raising the pullout sidewalls relative to the coupled platforms; that is, the pullout sidewalls at the lower end hangs from the coupled platforms with the angle between the two narrowed. At the same time, the side members housing these pullout sidewalls are placed in a raised state relative to the coupled platforms. This achieves the effect of supporting the side of the care recipient's body with the pullout sidewalls while keeping the care recipient in the flexion position, thereby allowing for postural changes to be performed excellently, as in embodiment 1.

3. Embodiment 3

FIGS. 26A to 26F show a structure of a turning bed in an embodiment 3.

The turning bed in embodiment 3, which can be used with general-purpose beds, is constituted by laying an air mattress formed from a plurality of airbags on a general-purpose bed. A characteristic of this turning bed is the use of an air pump (not depicted) to supply/discharge air independently for each airbag via an air hose. The air hose has a valve that is controlled to open/close by a control unit (not depicted), thus controlling the inflation/deflation of respective airbags. The airbags are, as one example, partitioned into upper body (double layer), lower back (double layer), upper leg, lower leg, and both sides of the bed so as to correspond to the joints of the care recipient's body.

Figure 26A:
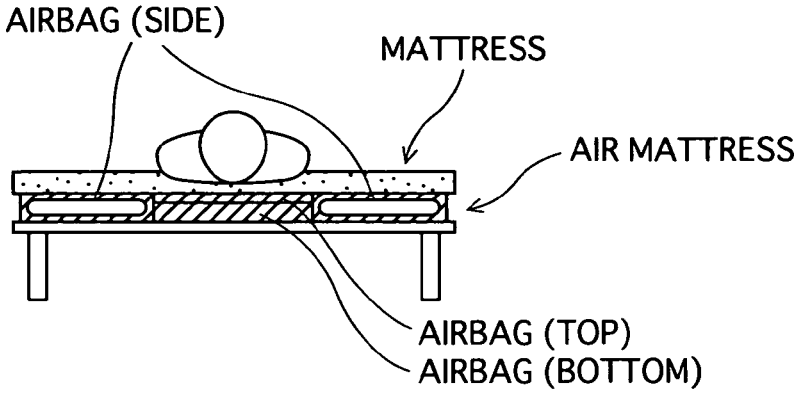
FIGS. 26A to 26F are perspective views of a turning bed in an embodiment 3.
Figure 26B:
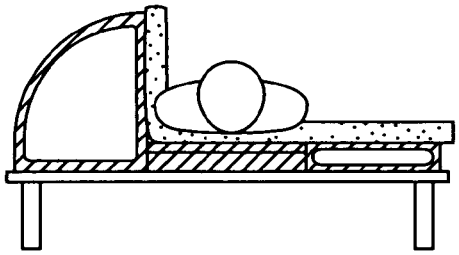
Figure 26C:
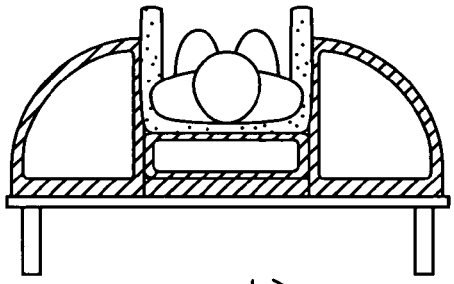
Figure 26D:
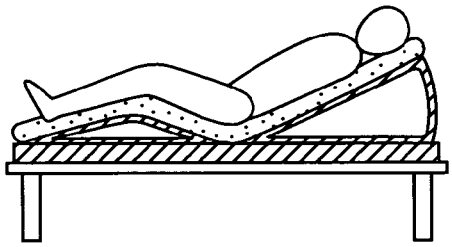
Figure 26E:
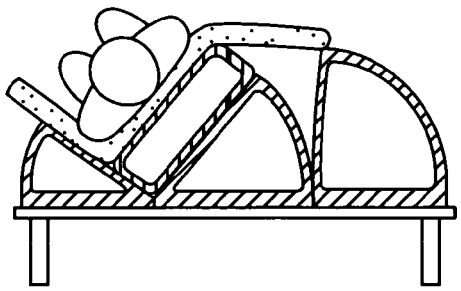
Figure 26F:
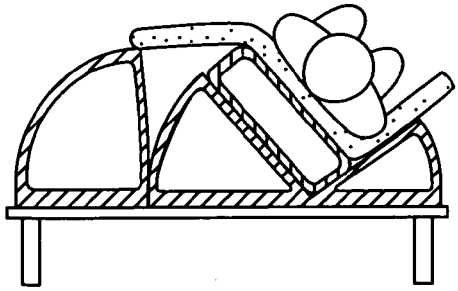

A turning bed having the above structure is normally used with a mattress or the like placed over the air mattress. When turning the care recipient from a supine to a lateral position, the upper airbags on both sides of the bed are firstly inflated (FIG. 26A→26C). Next, the care recipient is placed in the flexion position by tilting the airbags corresponding to the upper body and lower back in a longitudinal direction, and inflating the airbags corresponding to the upper and lower leg regions so as form a knee break (FIG. 26D). It is then possible to turn the care recipient to either the left or right lateral positions while maintaining the flexion position by deflating the airbag on either the left or right side, and inflating the lower of the two airbags corresponding to the upper body and lower back (FIG. 26E, 26F). According to this configuration, embodiment 3 achieves substantially the same effects as embodiments 1 and 2.

Note that while embodiment 3 shows an example using a general-purpose bed, the excellent portability of embodiment 3 means that the above turning bed can, in addition to being applied to a variety of general-purpose beds, also be laid directly on the floor (i.e. directly over tatami, carpet or the like).

4. Safety Fittings

Described here are safety fittings suitable for use with a turning bed as in the above embodiments.

4-1. Pillow, Armrest, Legrest

Figure 27A:
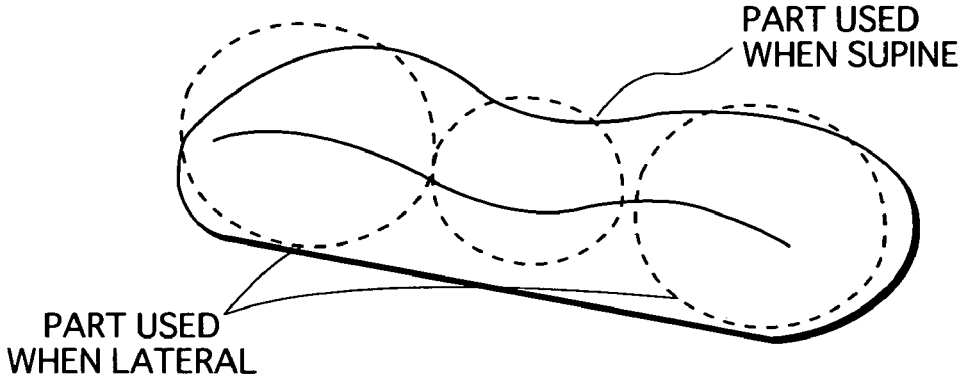
FIGS. 27A to 27C respectively show constructions of a pillow, an armrest, and a legrest for use with a turning bed.

FIG. 27A shows a pillow for use with a turning bed. A middle part of the pillow is depressed relative to the both sides, this depression being designed to fit the care recipient's head.

According to this structure, it is possible to stabilize the care recipient's head using the middle part of the pillow when the bed is stationary. Then, during the driving of the bed, the sides of the head are gently supported when the bed is tilted to either side and the care recipient's spine is kept substantially straight, enabling smooth postural changes to be performed.

Figure 27B:
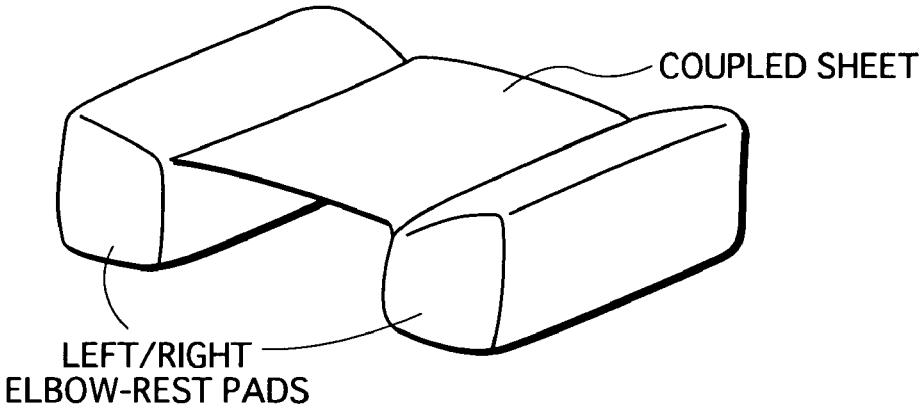

Next, FIG. 27B shows an armrest (cushion) for use with a turning bed. This armrest is formed from left and right columnar elbow-rest pads coupled to a band-shaped sheet. To use the armrest, the sides of the care recipient when lying on the bed are placed between the elbow-rest pads. In addition to supporting the care recipient's position on the bed to a certain degree, use of this armrest for a turning bed can also be expected to effectively prevent the care recipient from being sandwiched/pressed in on the sides when the bed is driven.

Figure 27C:
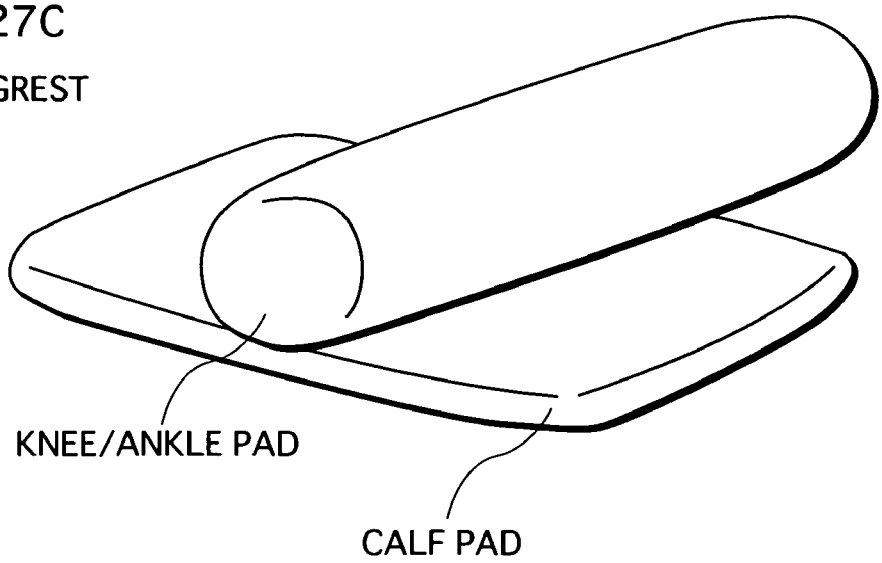

FIG. 27C shows a legrest (cushion) for use with a turning bed. This legrest is formed from a columnar knee/ankle pad joined to a band-shaped calf pad. To use the legrest, the knee/ankle pad is sandwiched between both legs and the calves are positioned on the calf pad so that the care recipient's heels are suspended above the bed surface. Use of this legrest allows the care recipient's knees and ankles to be kept together at all times whether the bed is stationary or moving, effectively preventing the occurrence of decubitus ulcers. The load on the care recipient's heels is also lightened, effectively preventing decubitus ulcers in the heel region.

4-2. Gloves

Figure 28A:
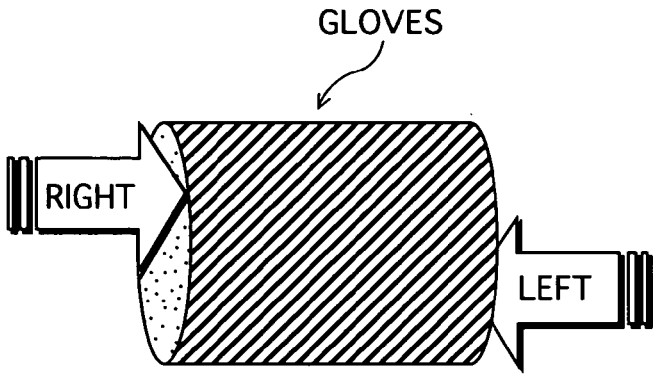
FIGS. 28A to 28C show an exemplary construction of gloves for use with a turning bed.
Figure 28B:
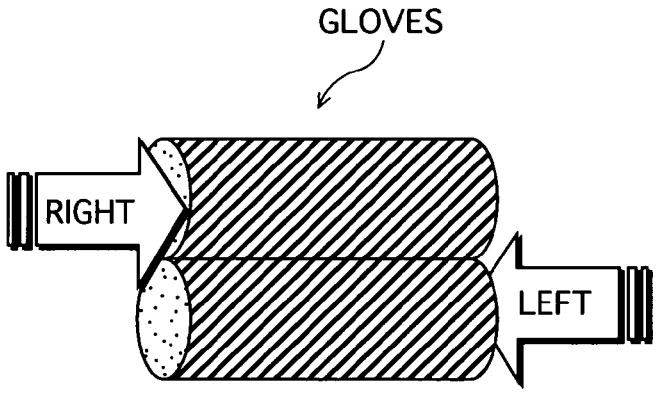
Figure 28C:
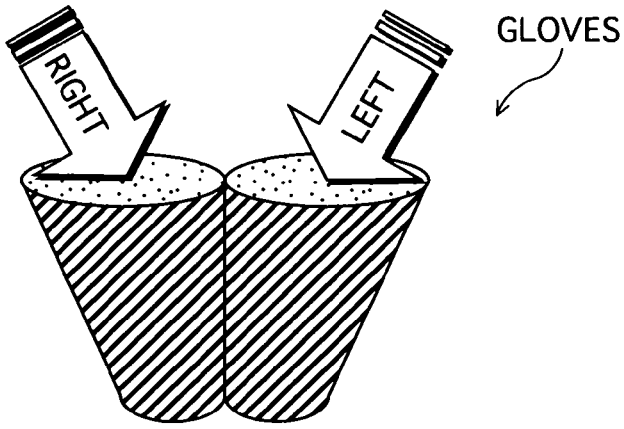

FIGS. 28A to 28C show gloves for use with a turning bed. These gloves are secured safely in front of the care recipient, so as not to interfere with arm movement when the turning bed is driven. The methods for securing the gloves include, as shown in the diagrams, lining them up side-by-side in a width direction of the bed (FIG. 28A/28B), and arranging them together in a longitudinal direction of the bed (FIG. 28C).

The gloves preferably are used together with the above armrest to increase effectiveness.

INDUSTRIAL APPLICABILITY

An adjustable bed according to the present invention can be used as a nursing care bed or a reclining bed.

The invention claimed is:

1. An adjustable bed comprising:

a platform having a flexible surface;

a flex mechanism adapted to flex the platform to form a flexion position that includes at least one of a sitting-up position and a knee break;

a tilt mechanism adapted to laterally tilt the platform surface correspondinrt to an area from an upper body to a lower leg of a bed user lying on the platform surface;

a side member disposed on each side of the platform; and a side-member lift mechanism adapted to raise the side member relative to the platform surface, wherein the flex and tilt mechanisms are both operable with the other mechanism in an operational state, and each tilt mechanism tilts the platform surface toward each side member raised by the side-member lift mechanism.

2. The adjustable bed of claim 1, wherein the flex mechanism forms the flexion position so that an upper leg of a bed user lying on the platform surface is tilted at an angle in a range of 10 degrees to 60 degrees inclusive at a time of the knee break.

3. The adjustable bed of claim 2, wherein the flex mechanism forms the flexion position so that the upper leg is tilted at an angle in a range of 20 degrees to 40 degrees inclusive at a time of the knee break.

4. The adjustable bed of claim 2, wherein the tilt mechanism is operable after the flexion position is formed by the flex mechanism.

5. The adjustable bed of claim 1:

wherein the tilt mechanism includes an elevation mechanism adapted to elevate the pair of side members up and down, and the platform surface is tilted and the side member at a lower end thereof is raised relative to the platform surface, by elevating at least one side of the platform surface using the elevation mechanism.

6. The adjustable bed of claim 5, wherein the platform is supported from undemeath by an adjustable stage that oscillates on a fixed stage, the adjustable bed comprises:

a load detection unit disposed between the fixed stage and at least one of the side members; and a tilt-mechanism control unit adapted to control a driving of the tilt mechanism based on a detection signal outputted from the load detection unit, and the tilt-mechanism control unit maintains the driving of the tilt mechanism in an OFF-state when the detection signal received from the load detection unit shows that a load of at least a predetermined value is on the at least one side member.

7. The adjustable bed of claim 5 wherein the platform is formed from a plurality of surface members supportcd from underneath by an adjustable stage that oscillates on a fixed stage, the flex mechanism has an actuator disposed on an underside of the platform and adapted to flex the platform by tilting one or more of the surface members, the tilt mechanism has a first and a second elevation mechanism capable of elevating both sides of the adjustable stage independently, and the flex and tilt mechanisms are independently operable.

8. The adjustable bed of claim 7 comprising a synchronized operation unit adapted, at an operation time of the first and second elevation mechanisms, to operate the first and second elevation mechanisms in synchronization so as to elevate the platform while maintaining the platform in a horizontal position.

9. The adjustable bed of claim 7, wherein the platform is a coupled platform formed from the surface members being coupled together, the flex mechanism drives the actuator, which is disposed on the underside of the coupled platform, to flex the coupled platform, the first and second elevation mechanisms each include a parallelogram mechanism adapted to elevate sides of the adjustable stage in a perpendicular direction using (i) a plurality of support arms that hang down parallel with one another from the respective side of the adjustable stage so as to extend in line with the side, (ii) a horizontal link arm disposed with respect to the support arms so as to extend in line with a flat surface of the bed, and (iii) a slide groove member disposed horizontally and connected to a lower end of the support arms so as to allow the support arms to travel freely, and the platform surface is tilted by separating one side of the adjustable stage and the respective horizontal link arm using another actuator, to lift the side.

10. The adjustable bed of claim 9, wherein the adjustable stage is (i) disposed on the fixed stage via a roller that rotates in a width direction of the platform, and (ii) has a mechanism adapted to tilt the platform surface while running the roller over the fixed stage when at least one of the parallelogram mechanisms is operated, and the roller includes a viscosity-generating unit adapted to control the roller to rotate smoothly when running over the fixed stage.

11. The adjustable bed of claim 9 comprising:

a slide-roller mechanism disposed on the coupled platform between the adjustable stage and a region corresponding to a foot of the adjustable bed, wherein the coupled platform and the adjustable stage are prevented from separating when the bed is driven, by a roller disposed on the coupled platform traveling in a slide groove provided in the adjustable stage.

12. A mattress for use with an adjustable bed comprising:

a platform having a flexible surface;

a flex mechanism adapted to flex the platform to form a flexion position that includes at least one of a sitting-up position and a knee break;

a tilt mechanism adapted to laterally tilt the platform surface corresponding to an area from an upper body to a lower leg of a bed user lying on the platform surface;

a side member disposed on each side of the platform; and a side-member lift mechanism adapted to raise the side member relative to the platform surface, wherein the flex and tilt mechanisms are both operable with the other mechanism in an operational state, the tilt mechanism tilts the platform surface toward each side member raised by the side-member lift mechanism, and mattress parts whose position corresponds respectively to each platform and each side member is made from a different material.

13. A mattress for use with an adjustable bed comprising:

a platform having a flexible surface;

a flex mechanism adapted to flex the platform to form a flexion position that includes at least one of a sitting-up position and a knee break;

a tilt mechanism adanted to laterally tilt the platform surface corresponding to an area from an upper body to a lower leg of a bed user lying on the platform surface;

a side member disposed on each side of the platform; and a side-member lift mechanism adapted to raise the side member relative to the platform surface, wherein the flex and tilt mechanisms are both operable with the other mechanism in an operational state, the tilt mechanism tilts the platform surface toward each side member raised by the side-member lift mechanism, and a slit is provided at a position corresponding to a boundary between each platform and each side member.

14. A mattress for an adjustable bed comprising:

a platform having a flexible surface;

a flex mechanism adapted to flex the platform to form a flexion position that includes at least one of a sitting-up position and a knee break;

a tilt mechanism adapted to laterally tilt the platform surface corresponding to an area from an upper body to a lower leg of a bed user lying on the platform surface;

a side member disposed on each side of the platform; and a side-member lift mechanism adapted to raise the side member relative to the platform surface, wherein the flex and tilt mechanisms are both operable with the other mechanism in an operational state, the tilt mechanism tilts the platform surface toward each side member raised by the side-member lift mechanism, and an alignment mark for each bed user to lie on the mattress is formed on a mattress surface.

15. A mattress for an adjustable bed comprising:

a platform having a flexible surface;

a flex mechanism adapted to flex the platform to form a flexion position that includes at least one of a sitting-up position and a knee break;

a tilt mechanism adapted to laterally tilt the platform surface corresponding to an area from an upper body to a lower leg of a bed user lying on the platform surface;

a side member disposed on each side of the platform; and a side-member lift mechanism adapted to raise the side member relative to the platform surface, wherein the flex and tilt mechanisms are both operable with the other mechanism in an operational state, the tilt mechanism tilts the platform surface toward each side member raised by the side-member lift mechanism, and a fixed implement is provided on a mattress surface facing each side member, so as to mate each mattress with the side member when the side-member lift mechanism is driven to raise the side member.

16. A body-position fitting for use by a bed user of an adjustable bed comprising:

a platform having a flexible surface;

a flex mechanism adapted to flex the platform to form a flexion position that includes at least one of a sitting-up position and a knee break;

a tilt mechanism adapted to laterally tilt the platform surface corresponding to an area from an upper body to a lower leg of a bed user lying on the platform surface;

a side member disposed on each side of the platform;

a side-member lift mechanism adapted to raise the side member relative to the platform surface; and a holding unit adapted to hold the bed user in a posture with hands corresponding to an abdominal region of the bed user, wherein the flex and tilt mechanisms are both operable with the other mechanism in an operational state, and each tilt mechanism tilts the platform surface toward each side member raised by the side-member lift mechanism.

17. A decubitus-ulcer prevention fitting for use by a bed user of an adjustable bed comprising:

a platform having a flexible surface;

a flex mechanism adapted to flex the nlatform to form a flexion position that includes at least one of a sitting-up position and a knee break;

a tilt mechanism adapted to laterally tilt the platform surface corresponding to an area from an upper body to a lower leg of a bed user lying on the platform surface;

a side member disposed on each side of the platform;

a side-member lift mechanism adapted to raise the side member relative to the platform surface; and a cushioning unit adapted to be interposed between legs of the bed user, wherein the flex and tilt mechanisms are both operable with the other mechanism in an operational state, and each tilt mechanism tilts the platform surface toward each side member raised by the side-member lift mechanism.

18. A sequence for adjusting an adjustable bed that includes a platform having a flexible surface, a flex mechanism adapted to flex the platform to form a flexion position which includes at least one of a sitting-up position and a knee break, a side member disposed on each side of the platform, a side-member lift mechanism adapted to raise each side member relative to the platform surface, and a tilt mechanism adapted to tilt the platform surface laterally, comprising:

a first step of operating the flex mechanism;

a second step of operating the side-member lift mechanism after the first step; and a third step of operating the tilt mechanism after the second step.

19. A sequence for adjusting an adjustable bed that includes a platform having a flexible surface, a flex mechanism adapted to flex the platform to form a flexion position which includes at least one of a sitting-up position and a knee break, a side member disposed on each side of the platform, a side-member lift mechanism adapted to raise each side member relative to the platform surface, and a tilt mechanism adapted to tilt the platform surface laterally, comprising:

a side-member lift step of raising each side member to a predetermined angle at a drive time of the side-member lift mechanism;

a tilt step of operating the tilt mechanism after the side-member lift step; and a release control step of performing a release control after the tilt step, by lowering the side member from the predetermined angle to an obtuse angle.

20. A sequence for adjusting an adjustable bed that includes a platform having a flexible surface, a flex mechanism adapted to flex the platform to form a flexion position which includes at least one of a sitting-up position and a knee break, a side member disposed on each side of the platform, a side-member lift mechanism adapted to raise each side member relative to the platform surface, and a tilt mechanism adapted to tilt the platform surface laterally, the side-member lift mechanism and the tilt mechanism being driven independently of each other comprising the step of;

driving the bed while synchronizing (i) a rate of change of an angle at which the platform is tilted by the tilt mechanism relative to a horizontal surface, and (ii) a rate of change of an angle at which each side member is tilted by the side-member lift mechanism relative to the platform.

* * * * *